US008297947B2

(12) United States Patent
Van Rensburg et al.

(10) Patent No.: US 8,297,947 B2
(45) Date of Patent: Oct. 30, 2012

(54) FLUID DISC PUMP

(75) Inventors: Richard Janse Van Rensburg, Cambridgeshire (GB); Stuart Andrew Hatfield, Cambridgeshire (GB); Justin Rorke Buckland, Cambridgeshire (GB); James Edward McCrone, Cambridgeshire (GB)

(73) Assignee: The Technology Partnership Plc, Hertfordshire (GB)

( * ) Notice: Subject to any disclaimer, the term of this patent is extended or adjusted under 35 U.S.C. 154(b) by 559 days.

(21) Appl. No.: 12/477,634

(22) Filed: Jun. 3, 2009

(65) Prior Publication Data

US 2010/0310398 A1 Dec. 9, 2010

(51) Int. Cl.
*F04B 17/00* (2006.01)

(52) U.S. Cl. ..... 417/413.2; 417/213; 417/307; 417/413.1

(58) Field of Classification Search ..... 417/413.1, 417/410.2; 977/723, 724; 137/493, 493.8, 137/493.9, 565.01, 855, 852, 859
See application file for complete search history.

(56) References Cited

U.S. PATENT DOCUMENTS

| | | | | |
|---|---|---|---|---|
| 6,203,291 | B1 * | 3/2001 | Stemme et al. | 417/413.3 |
| 2001/0035700 | A1 | 11/2001 | Percin et al. | |
| 2002/0146333 | A1 * | 10/2002 | Drevet | 417/410.1 |
| 2007/0035213 | A1 | 2/2007 | Nakajima | |
| 2009/0087323 | A1 * | 4/2009 | Blakey et al. | 417/413.2 |

FOREIGN PATENT DOCUMENTS

| | | | |
|---|---|---|---|
| JP | 2009-156454 | | 7/2009 |
| WO | WO-94/19609 | A1 | 9/1994 |
| WO | WO 2006/111775 | A1 | 10/2006 |
| WO | WO-2009-072261 | A1 | 6/2009 |
| WO | WO-2009-087714 | A1 | 7/2009 |

OTHER PUBLICATIONS

International Search Report completed on Sep. 30, 2009 and mailed Oct. 12, 2009 (14 pgs.).

* cited by examiner

*Primary Examiner* — Joseph L Williams
*Assistant Examiner* — Fatima Farokhrooz
(74) *Attorney, Agent, or Firm* — Tarolli, Sundheim, Covell & Tummino LLP

(57) ABSTRACT

A pump having a substantially cylindrical shape and defining a cavity formed by a side wall closed at both ends by end walls wherein the cavity contains a fluid is disclosed. The pump further comprises an actuator operatively associated with at least one of the end walls to cause an oscillatory motion of the driven end wall to generate displacement oscillations of the driven end wall within the cavity. The pump further comprises an isolator operatively associated with a peripheral portion of the driven end wall to reduce dampening of the displacement oscillations. The pump further comprises a valve for controlling the flow of fluid through the valve. The valve has first and second plates with offsetting apertures and a sidewall disposed between the plates around the perimeter of the plates to form a cavity in fluid communication with the apertures. The valve further comprises a flap disposed and moveable between the first and second plates and having apertures substantially offset from the apertures of one plate and substantially aligned with the apertures of the other plate. The flap is motivated between the two plates in response to a change in direction of the differential pressure of fluid across the valve.

47 Claims, 12 Drawing Sheets

FIG. 9A
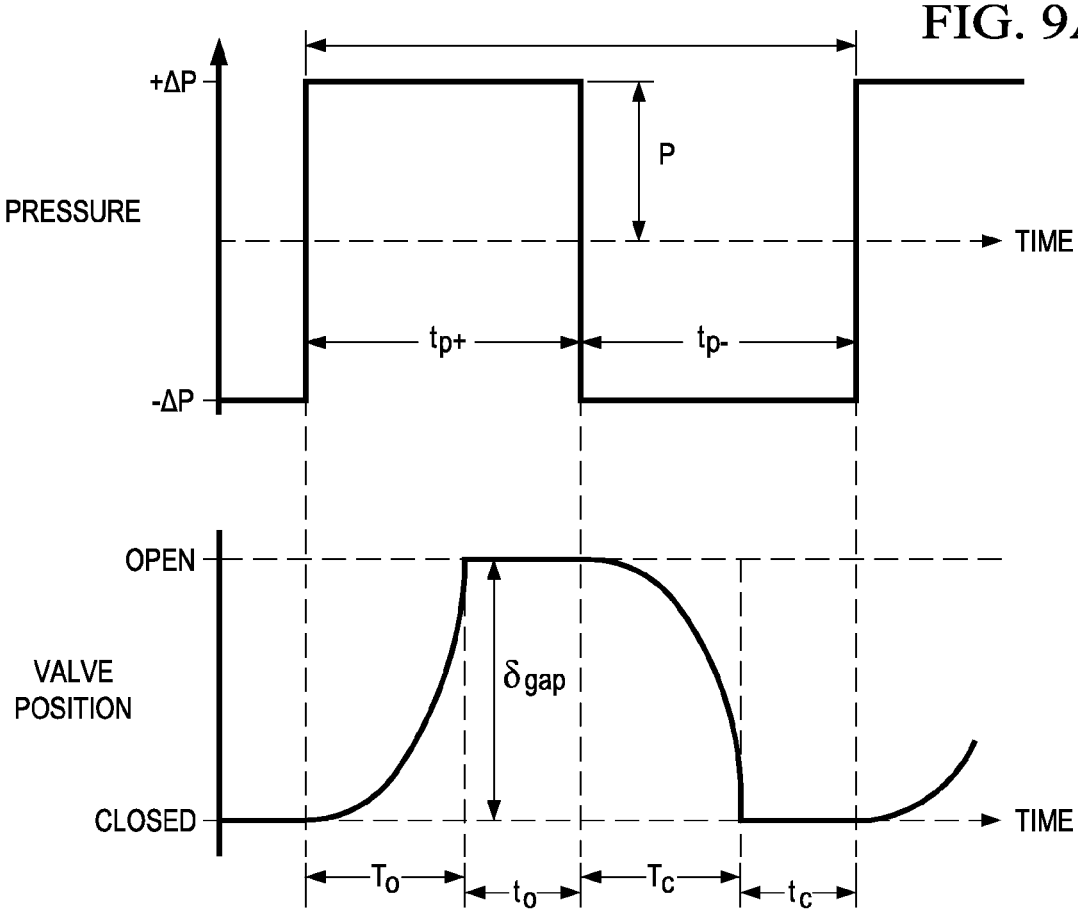
FIG. 9B
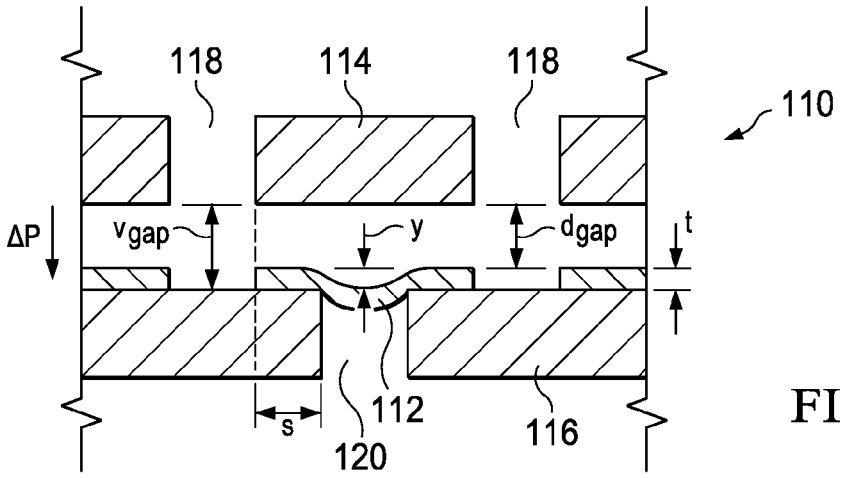
FIG. 10

FLUID DISC PUMP

BACKGROUND OF THE INVENTION

1. Field of the Invention

The illustrative embodiments of the invention relate generally to a pump for fluid and, more specifically, to a pump having a substantially disc-shaped cavity with substantially circular end walls and a side wall and a valve for controlling the flow of fluid through the pump.

2. Description of Related Art

The generation of high amplitude pressure oscillations in closed cavities has received significant attention in the fields of thermo-acoustics and pump type compressors. Recent developments in non-linear acoustics have allowed the generation of pressure waves with higher amplitudes than previously thought possible.

It is known to use acoustic resonance to achieve fluid pumping from defined inlets and outlets. This can be achieved using a cylindrical cavity with an acoustic driver at one end, which drives an acoustic standing wave. In such a cylindrical cavity, the acoustic pressure wave has limited amplitude. Varying cross-section cavities, such as cone, horn-cone, bulb have been used to achieve high amplitude pressure oscillations thereby significantly increasing the pumping effect. In such high amplitude waves the non-linear mechanisms with energy dissipation have been suppressed. However, high amplitude acoustic resonance has not been employed within disc-shaped cavities in which radial pressure oscillations are excited until recently. International Patent Application No. PCT/GB2006/001487, published as WO 2006/111775 (the '487 Application), discloses a pump having a substantially disc-shaped cavity with a high aspect ratio, i.e., the ratio of the radius of the cavity to the height of the cavity.

Such a pump has a substantially cylindrical cavity comprising a side wall closed at each end by end walls. The pump also comprises an actuator that drives either one of the end walls to oscillate in a direction substantially perpendicular to the surface of the driven end wall. The spatial profile of the motion of the driven end wall is described as being matched to the spatial profile of the fluid pressure oscillations within the cavity, a state described herein as mode-matching. When the pump is mode-matched, work done by the actuator on the fluid in the cavity adds constructively across the driven end wall surface, thereby enhancing the amplitude of the pressure oscillation in the cavity and delivering high pump efficiency. In a pump which is not mode-matched there may be areas of the end wall wherein the work done by the end wall on the fluid reduces rather than enhances the amplitude of the fluid pressure oscillation in the fluid within the cavity. Thus, the useful work done by the actuator on the fluid is reduced and the pump becomes less efficient. The efficiency of a mode-matched pump is dependent upon the interface between the driven end wall and the side wall. It is desirable to maintain the efficiency of such pump by structuring the interface so that it does not decrease or dampen the motion of the driven end wall thereby mitigating any reduction in the amplitude of the fluid pressure oscillations within the cavity.

Such pumps also require a valve for controlling the flow of fluid through the pump and, more specifically, a valve being capable of operating at high frequencies. Conventional valves typically operate at lower frequencies below 500 Hz for a variety of applications. For example, many conventional compressors typically operate at 50 or 60 Hz. Linear resonance compressors known in the art operate between 150 and 350 Hz. However, many portable electronic devices including medical devices require pumps for delivering a positive pressure or providing a vacuum that are relatively small in size and it is advantageous for such pumps to be inaudible in operation so as to provide discrete operation. To achieve these objectives, such pumps must operate at very high frequencies requiring valves capable of operating at about 20 kHz and higher which are not commonly available. To operate at these high frequencies, the valve must be responsive to a high frequency oscillating pressure that can be rectified to create a net flow of fluid through the pump.

SUMMARY

According to one embodiment of the invention, the actuator of the pump described above causes an oscillatory motion of the driven end wall ("displacement oscillations") in a direction substantially perpendicular to the end wall or substantially parallel to the longitudinal axis of the cylindrical cavity, referred to hereinafter as "axial oscillations" of the driven end wall within the cavity. The axial oscillations of the driven end wall generate substantially proportional "pressure oscillations" of fluid within the cavity creating a radial pressure distribution approximating that of a Bessel function of the first kind as described in the '487 Application which is incorporated by reference herein, such oscillations referred to hereinafter as "radial oscillations" of the fluid pressure within the cavity. A portion of the driven end wall between the actuator and the side wall provides an interface with the side wall of the pump that decreases dampening of the displacement oscillations to mitigate any reduction of the pressure oscillations within the cavity, that portion being referred to hereinafter as an "isolator." The illustrative embodiments of the isolator are operatively associated with the peripheral portion of the driven end wall to reduce dampening of the displacement oscillations.

According to another embodiment of the invention, a pump comprises a pump body having a substantially cylindrical shape defining a cavity formed by a side wall closed at both ends by substantially circular end walls, at least one of the end walls being a driven end wall having a central portion and a peripheral portion adjacent the side wall, wherein the cavity contains a fluid when in use. The pump further comprises an actuator operatively associated with the central portion of the driven end wall to cause an oscillatory motion of the driven end wall in a direction substantially perpendicular thereto with a maximum amplitude at about the centre of the driven end wall, thereby generating displacement oscillations of the driven end wall when in use. The pump further comprises an isolator operatively associated with the peripheral portion of the driven end wall to reduce dampening of the displacement oscillations caused by the end wall's connection to the side wall of the cavity. The pump further comprises a first aperture disposed at about the centre of one of the end walls, and a second aperture disposed at any other location in the pump body, whereby the displacement oscillations generate radial oscillations of fluid pressure within the cavity of said pump body causing fluid flow through said apertures.

According to yet another embodiment of the invention, the pump comprises a valve disposed in either the first or second aperture for controlling the flow of fluid through the pump. The valve comprises a first plate having apertures extending generally perpendicular therethrough and a second plate also having apertures extending generally perpendicular therethrough, wherein the apertures of the second plate are substantially offset from the apertures of the first plate. The valve further comprises a sidewall disposed between the first and second plate, wherein the sidewall is closed around the perimeter of the first and second plates to form a cavity between the first and second plates in fluid communication with the apertures of the first and second plates. The valve further comprises a flap disposed and moveable between the first and second plates, wherein the flap has apertures substantially offset from the apertures of the first plate and substantially aligned with the apertures of the second plate. The flap is motivated between the first and second plates in response to a change in direction of the differential pressure of the fluid across the valve.

Other objects, features, and advantages of the illustrative embodiments are described herein and will become apparent with reference to the drawings and detailed description that follow.

BRIEF DESCRIPTION OF THE DRAWINGS

FIG. 9A shows a graph of an oscillating differential pressure applied across the valve of FIG. 7B according to an illustrative embodiment;

FIG. 9B shows a graph of an operating cycle of the valve of FIG. 7B between an open and closed position;

FIG. 10 shows a schematic cross-section view of a portion of the valve of FIG. 7B in the closed position according to an illustrative embodiment;

DETAILED DESCRIPTION OF ILLUSTRATIVE EMBODIMENTS

In the following detailed description of several illustrative embodiments, reference is made to the accompanying drawings that form a part hereof: and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1A:
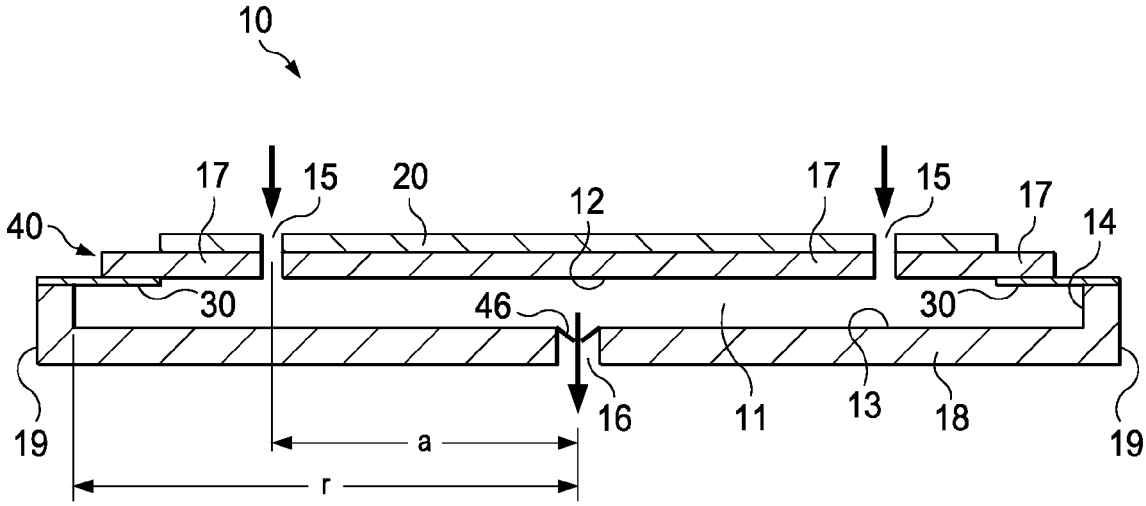
FIGS. 1A to 1C show a schematic cross-section view of a first pump according to an illustrative embodiment of the inventions that provide a positive pressure, a graph of the displacement oscillations of the driven end wall of the pump, and a graph of the pressure oscillations of fluid within the cavity of pump.
Figure 1B:
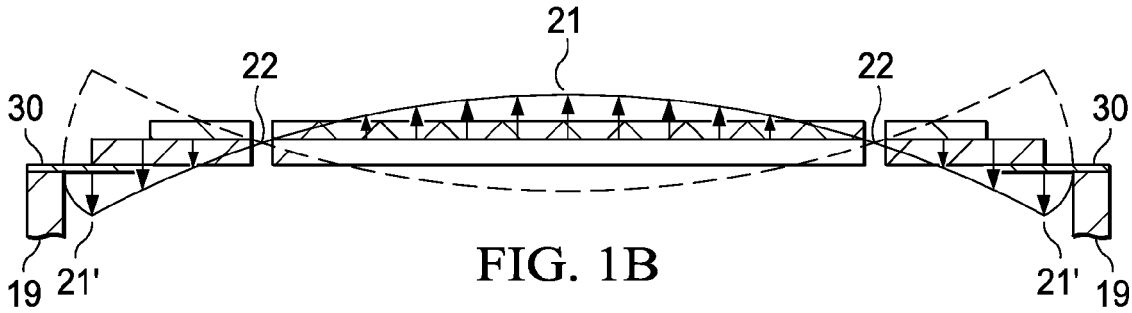

FIG. 1A is a schematic cross-section view of a pump 10 according to an illustrative embodiment of the invention. Referring also to FIG. 1B, pump 10 comprises a pump body having a substantially cylindrical shape including a cylindrical wall 19 closed at one end by a base 18 and closed at the other end by a end plate 17 and a ring-shaped isolator 30 disposed between the end plate 17 and the other end of the cylindrical wall 19 of the pump body. The cylindrical wall 19 and base 18 may be a single component comprising the pump body and may be mounted to other components or systems. The internal surfaces of the cylindrical wall 19, the base 18, the end plate 17, and the isolator 30 form a cavity 11 within the pump 10 wherein the cavity 11 comprises a side wall 14 closed at both ends by end walls 12 and 13. The end wall 13 is the internal surface of the base 18 and the side wall 14 is the inside surface of the cylindrical wall 19. The end wall 12 comprises a central portion corresponding to the inside surface of the end plate 17 and a peripheral portion corresponding to the inside surface of the isolator 30. Although the cavity 11 is substantially circular in shape, the cavity 11 may also be elliptical or other shape. The base 18 and cylindrical wall 19 of the pump body may be formed from any suitable rigid material including, without limitation, metal, ceramic, glass, or plastic including, without limitation, inject-molded plastic.

The pump 10 also comprises a piezoelectric disc 20 operatively connected to the end plate 17 to form an actuator 40 that is operatively associated with the central portion of the end wall 12 via the end plate 17. The piezoelectric disc 20 is not required to be formed of a piezoelectric material, but may be formed of any electrically active material that vibrates such as, for example, an electrostrictive or magnetostrictive material. The end plate 17 preferably possesses a bending stiffness similar to the piezoelectric disc 20 and may be formed of an electrically inactive material such as a metal or ceramic. When the piezoelectric disc 20 is excited by an electrical current, the actuator 40 expands and contracts in a radial direction relative to the longitudinal axis of the cavity 11 causing the end plate 17 to bend, thereby inducing an axial deflection of the end wall 12 in a direction substantially perpendicular to the end wall 12. The end plate 17 alternatively may also be formed from an electrically active material such as, for example, a piezoelectric, magnetostrictive, or electrostrictive material. In another embodiment, the piezoelectric disc 20 may be replaced by a device in a force-transmitting relation with the end wall 12 such as, for example, a mechanical, magnetic or electrostatic device, wherein the end wall 12 may be formed as an electrically inactive or passive layer of material driven into oscillation by such device (not shown) in the same manner as described above.

The pump 10 further comprises at least two apertures extending from the cavity 11 to the outside of the pump 10, wherein at least a first one of the apertures may contain a valve to control the flow of fluid through the aperture. Although the aperture containing a valve may be located at any position in the cavity 11 where the actuator 40 generates a pressure differential as described below in more detail, one preferred embodiment of the pump 10 comprises an aperture with a valve located at approximately the centre of either of the end walls 12,13. The pump 10 shown in FIGS. 1A and 1B comprises a primary aperture 16 extending from the cavity 11 through the base 18 of the pump body at about the centre of the end wall 13 and containing a valve 46. The valve 46 is mounted within the primary aperture 16 and permits the flow of fluid in one direction as indicated by the arrow so that it functions as an outlet for the pump 10. The second aperture 15 may be located at any position within the cavity 11 other than the location of the aperture 16 with a valve 46. In one preferred embodiment of the pump 10, the second aperture is disposed between the centre of either one of the end walls 12,13 and the side wall 14. The embodiment of the pump 10 shown in FIGS. 1A and 1B comprises two secondary apertures 15 extending from the cavity 11 through the actuator 40 that are disposed between the centre of the end wall 12 and the side wall 14. Although the secondary apertures 15 are not valved in this embodiment of the pump 10, they may also be valved to improve performance if necessary. In this embodiment of the pump 10, the primary aperture 16 is valved so that the fluid is drawn into the cavity 11 of the pump 10 through the secondary apertures 15 and pumped out of the cavity 11 through the primary aperture 16 as indicated by the arrows to provide a positive pressure at the primary aperture 16.

Figure 3:
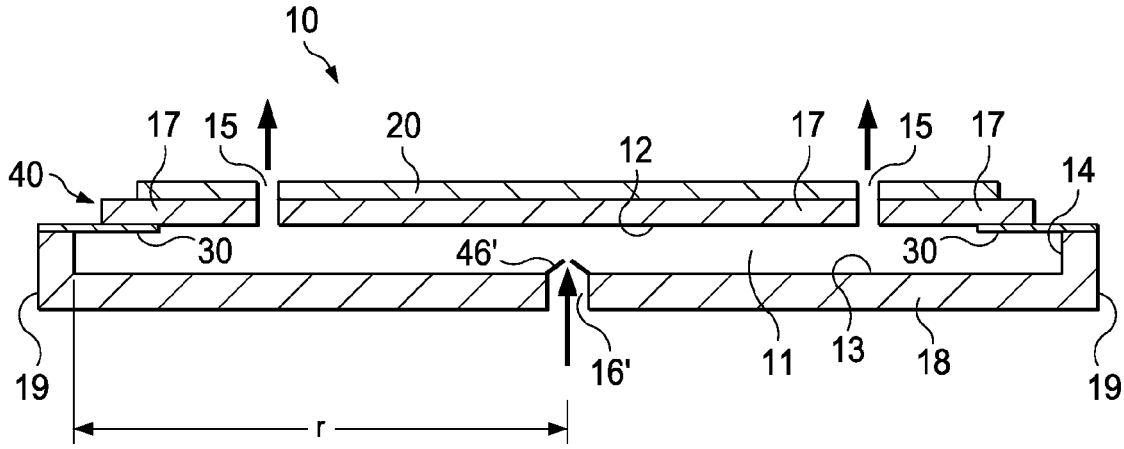
FIG. 3 shows a schematic cross-section view of a second pump according to an illustrative embodiment of the inventions that provides a negative pressure.

Referring to FIG. 3, the pump 10 of FIG. 1 is shown with an alternative configuration of the primary aperture 16. More specifically, the valve 46' in the primary aperture 16' is reversed so that the fluid is drawn into the cavity 11 through the primary aperture 16' and expelled out of the cavity 11 through the secondary apertures 15 as indicated by the arrows, thereby providing suction or a source of reduced pressure at the primary aperture 16'. The term "reduced pressure" as used herein generally refers to a pressure less than the ambient pressure where the pump 10 is located. Although the term "vacuum" and "negative pressure" may be used to describe the reduced pressure, the actual pressure reduction may be significantly less than the pressure reduction normally associated with a complete vacuum. The pressure is "negative" in the sense that it is a gauge pressure, i.e., the pressure is reduced below ambient atmospheric pressure. Unless otherwise indicated, values of pressure stated herein are gauge pressures. References to increases in reduced pressure typically refer to a decrease in absolute pressure, while decreases in reduced pressure typically refer to an increase in absolute pressure.

Figure 4:
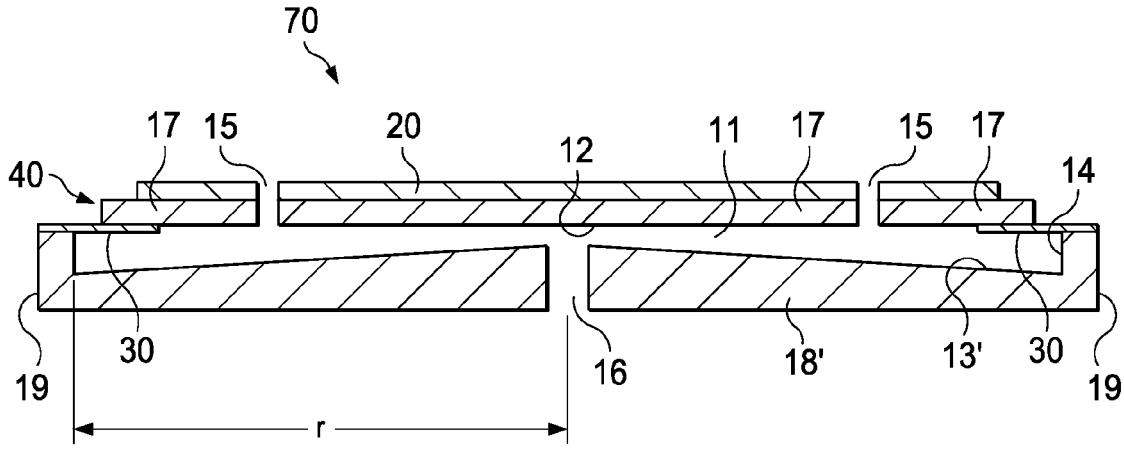
FIG. 4 shows a schematic cross-section view of a third pump according to an illustrative embodiment of the inventions having a frusto-conical base.

Referring now to FIG. 4, a pump 70 according to another illustrative embodiment of the invention is shown. The pump 70 is substantially similar to the pump 10 of FIG. 1 except that the pump body has a base 18' having an upper surface forming the end wall 13' which is frusto-conical in shape. Consequently, the height of the cavity 11 varies from the height at the side wall 14 to a smaller height between the end walls 12,13' at the centre of the end walls 12,13'. The frusto-conical shape of the end wall 13' intensifies the pressure at the centre of the cavity 11 where the height of the cavity 11 is smaller relative to the pressure at the side wall 14 of the cavity 11 where the height of the cavity 11 is larger. Therefore, comparing cylindrical and frusto-conical cavities 11 having equal central pressure amplitudes, it is apparent that the frusto-conical cavity 11 will generally have a smaller pressure amplitude at positions away from the centre of the cavity 11: the increasing height of the cavity 11 acts to reduce the amplitude of the pressure wave. As the viscous and thermal energy losses experienced during the oscillations of the fluid in the cavity 11 both increase with the amplitude of such oscillations, it is advantageous to the efficiency of the pump 70 to reduce the amplitude of the pressure oscillations away from the centre of the cavity 11 by employing a frusto-conical cavity 11 design. In one illustrative embodiment of the pump 70 where the diameter of the cavity 11 is approximately 20 mm, the height of the cavity 11 at the side wall 14 is approximately 1.0 mm tapering to a height at the centre of the end wall 13' of approximately 0.3 mm. Either one of the end walls 12,13 or both of the end walls 12,13 may have a frusto-conical shape.

Figure 5:
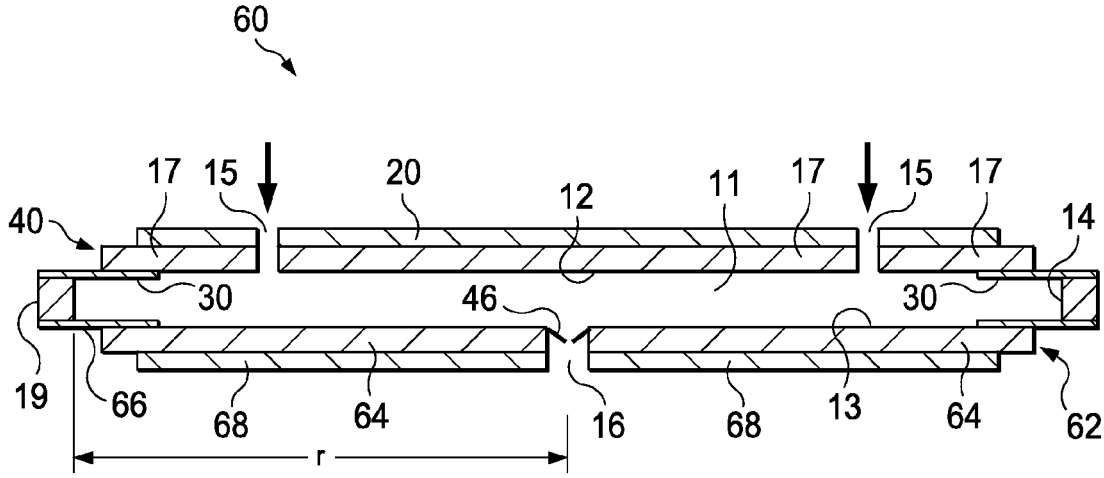
FIG. 5 shows a schematic cross-section view of a fourth pump according to another illustrative embodiment of the invention including two actuators.

Referring now to FIG. 5, a pump 60 according to another illustrative embodiment of the invention is shown. The pump 60 is substantially similar to the pump 10 of FIG. 1 except that it includes a second actuator 62 that replaces the base 18 of the pump body. The actuator 62 comprises a second disc 64 and a ring-shaped isolator 66 disposed between the disc 64 and the side wall 14. The pump 60 also comprises a second piezoelectric disc 68 operatively connected to the disc 64 to form the actuator 62. The actuator 62 is operatively associated with the end wall 13 which comprises the inside surfaces of the disc 64 and the isolator 66. The second actuator 62 also generates an oscillatory motion of the end wall 13 in a direction substantially perpendicular to the end wall 13 in a manner similar to the actuator 40 with respect to the end wall 12 as described above. When the actuators 40, 62 are activated, control circuitry (not shown) is provided to coordinate the axial displacement oscillations of the actuators. It is preferable that the actuators are driven at the same frequency and approximately out-of-phase, i.e. such that the centres of the end walls 12, 13 move first towards each other and then apart.

The dimensions of the pumps described herein should preferably satisfy certain inequalities with respect to the relationship between the height (h) of the cavity 11 and the radius (r) of the cavity which is the distance from the longitudinal axis of the cavity 11 to the side wall 14. These equations are as follows:

$r/h>1.2$; and $h^2/r>4\times10^{-10}$ meters.

In one embodiment of the invention, the ratio of the cavity radius to the cavity height (r/h) is between about 10 and about 50 when the fluid within the cavity 11 is a gas. In this example, the volume of the cavity 11 may be less than about 10 ml. Additionally, the ratio of $h^2/r$ is preferably within a range between about $10^{-3}$ and about $10^{-6}$ meters where the working fluid is a gas as opposed to a liquid.

In one embodiment of the invention the secondary apertures 15 are located where the amplitude of the pressure oscillations within the cavity 11 is close to zero, i.e., the "nodal" points of the pressure oscillations. Where the cavity 11 is cylindrical, the radial dependence of the pressure oscillation may be approximated by a Bessel function of the first kind and the radial node of the lowest-order pressure oscillation within the cavity 11 occurs at a distance of approximately 0.63r±0.2r from the centre of the end wall 12 or the longitudinal axis of the cavity 11. Thus, the secondary apertures 15 are preferably located at a radial distance (a) from the centre of the end walls 12,13, where (a)≈0.63r±0.2r, i.e., close to the nodal points of the pressure oscillations.

Additionally, the pumps disclosed herein should preferably satisfy the following inequality relating the cavity radius (r) and operating frequency (f) which is the frequency at which the actuator 40 vibrates to generate the axial displacement of the end wall 12. The inequality equation is as follows:

$$\frac{k_0(c_s)}{2\pi f} \le r \le \frac{k_0(c_f)}{2\pi f} \qquad \text{[Equation 1]}$$

wherein the speed of sound in the working fluid within the cavity 11 ($c$) may range between a slow speed ($c_s$) of about 115 m/s and a fast speed ($c_r$) equal to about 1,970 m/s as expressed in the equation above, and $k_0$ is a constant ($k_0$=3.83). The frequency of the oscillatory motion of the actuator 40 is preferably about equal to the lowest resonant frequency of radial pressure oscillations in the cavity 11, but may be within 20% therefrom. The lowest resonant frequency of radial pressure oscillations in the cavity 11 is preferably greater than 500 Hz.

Referring now to the pump 10 in operation, the piezoelectric disc 20 is excited to expand and contract in a radial direction against the end plate 17 which causes the actuator 40 to bend, thereby inducing an axial displacement of the driven end wall 12 in a direction substantially perpendicular to the driven end wall 12. The actuator 40 is operatively associated with the central portion of the end wall 12 as described above so that the axial displacement oscillations of the actuator 40 cause axial displacement oscillations along the surface of the end wall 12 with maximum amplitudes of oscillations, i.e., anti-node displacement oscillations, at about the centre of the end wall 12. Referring back to FIG. 1A, the displacement oscillations and the resulting pressure oscillations of the pump 10 as generally described above are shown more specifically in FIGS. 1B and 1C, respectively. The phase relationship between the displacement oscillations and pressure oscillations may vary, and a particular phase relationship should not be implied from any figure.

FIG. 1B shows one possible displacement profile illustrating the axial oscillation of the driven end wall 12 of the cavity 11. The solid curved line and arrows represent the displacement of the driven end wall 12 at one point in time, and the dashed curved line represents the displacement of the driven end wall 12 one half-cycle later. The displacement as shown in this figure and the other figures is exaggerated. Because the actuator 40 is not rigidly mounted at its perimeter, but rather suspended by the isolator 30, the actuator 40 is free to oscillate about its centre of mass in its fundamental mode. In this fundamental mode, the amplitude of the displacement oscillations of the actuator 40 is substantially zero at an annular displacement node 22 located between the centre of the end wall 12 and the side wall 14. The amplitudes of the displacement oscillations at other points on the end wall 12 have an amplitudes greater than zero as represented by the vertical arrows. A central displacement anti-node 21 exists near the centre of the actuator 40 and a peripheral displacement anti-node 21 exists near the perimeter of the actuator 40.

Figure 1C:
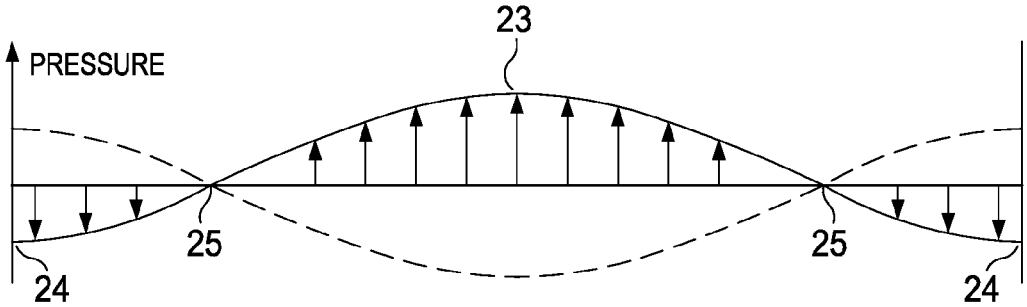
Figure 2:
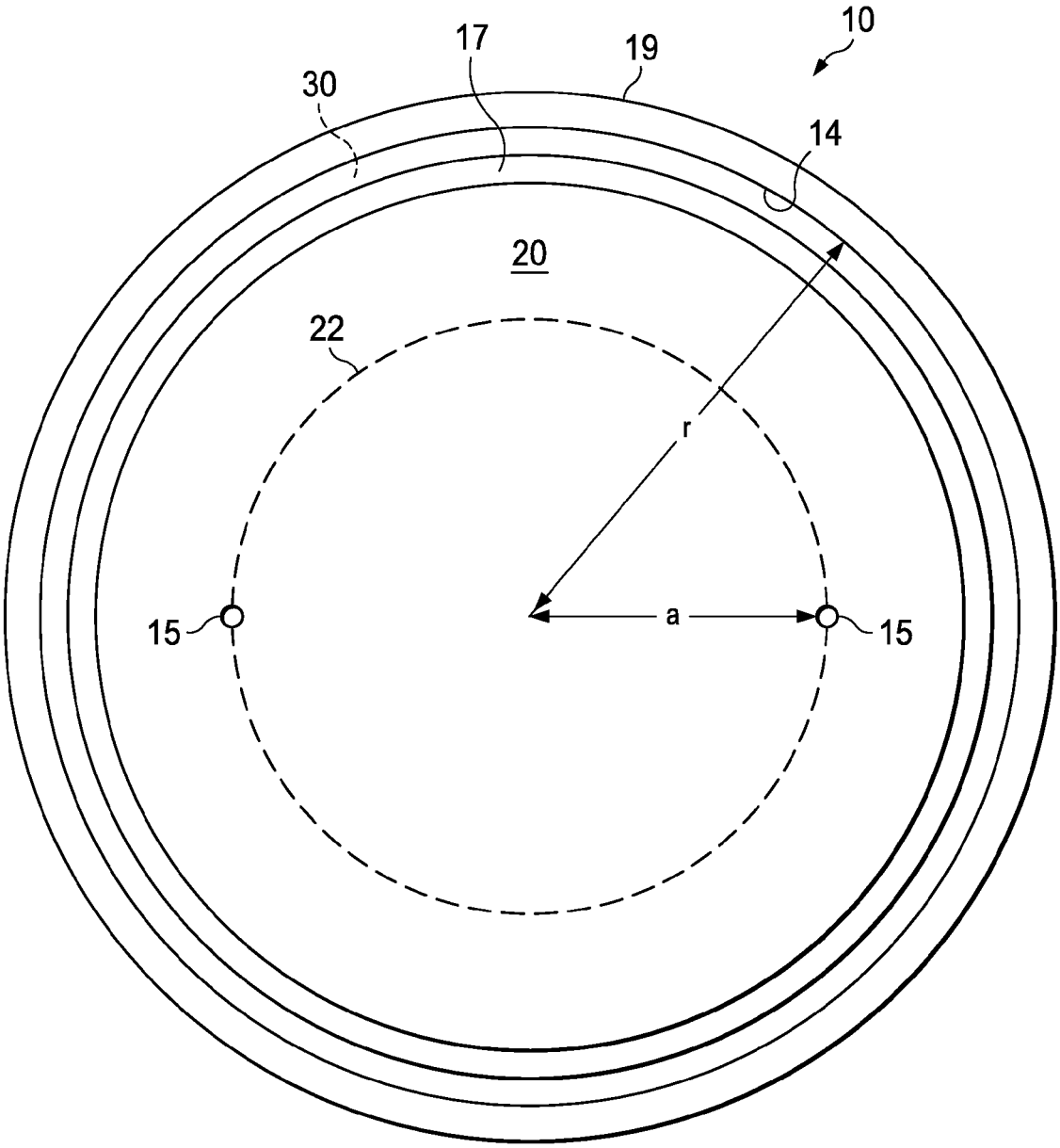
FIG. 2 shows a schematic top view of the first pump of FIG. 1A.

FIG. 1C shows one possible pressure oscillation profile illustrating the pressure oscillation within the cavity 11 resulting from the axial displacement oscillations shown in FIG. 1B. The solid curved line and arrows represent the pressure at one point in time, and the dashed curved line represents the pressure one half-cycle later. In this mode and higher-order modes, the amplitude of the pressure oscillations has a central pressure anti-node 23 near the centre of the cavity 11 and a peripheral pressure anti-node 24 near the side wall 14 of the cavity 11. The amplitude of the pressure oscillations is substantially zero at the annular pressure node 25 between the central pressure anti-node 23 and the peripheral pressure anti-node 24. For a cylindrical cavity, the radial dependence of the amplitude of the pressure oscillations in the cavity 11 may be approximated by a Bessel function of the first kind. The pressure oscillations described above result from the radial movement of the fluid in the cavity 11, and so will be referred to as the "radial pressure oscillations" of the fluid within the cavity 11 as distinguished from the axial displacement oscillations of the actuator 40.

With further reference to FIGS. 1B and 1C, it can be seen that the radial dependence of the amplitude of the axial displacement oscillations of the actuator 40 (the "mode-shape" of the actuator 40) should approximate a Bessel function of the first kind so as to match more closely the radial dependence of the amplitude of the desired pressure oscillations in the cavity 11 (the "mode-shape" of the pressure oscillation). By not rigidly mounting the actuator 40 at its perimeter and allowing it to vibrate more freely about its centre of mass, the mode-shape of the displacement oscillations substantially matches the mode-shape of the pressure oscillations in the cavity 11, thus achieving mode-shape matching or, more simply, mode-matching. Although the mode-matching may not always be perfect in this respect, the axial displacement oscillations of the actuator 40 and the corresponding pressure oscillations in the cavity 11 have substantially the same relative phase across the full surface of the actuator 40 wherein the radial position of the annular pressure node 25 of the pressure oscillations in the cavity 11 and the radial position of the annular displacement node 22 of the axial displacement oscillations of actuator 40 are substantially coincident.

As the actuator 40 vibrates about its centre of mass, the radial position of the annular displacement node 22 will necessarily lie inside the radius of the actuator 40 when the actuator 40 vibrates in its fundamental mode as illustrated in FIG. 1B. Thus, to ensure that the annular displacement node 22 is coincident with the annular pressure node 25, the radius of the actuator ($r_{act}$) should preferably be greater than the radius of the annular pressure node 25 to optimize mode-matching. Assuming again that the pressure oscillation in the cavity 11 approximates a Bessel function of the first kind, the radius of the annular pressure node 25 would be approximately 0.63 of the radius from the centre of the end wall 13 to the side wall 14, i.e., the radius of the cavity 11 ($r$) as shown in FIG. 1A. Therefore, the radius of the actuator 40 ($r_{act}$) should preferably satisfy the following inequality: $r_{act} \geqq 0.63r$.

The isolator 30 may be a flexible membrane which enables the edge of the actuator 40 to move more freely as described above by bending and stretching in response to the vibration of the actuator 40 as shown by the displacement of the peripheral displacement oscillations 21' in FIG. 1B. The flexible membrane overcomes the potential dampening effects of the side wall 14 on the actuator 40 by providing a low mechanical impedance support between the actuator 40 and the cylindrical wall 19 of the pump 10 thereby reducing the dampening of the axial oscillations of the peripheral displacement oscillations 21' of the actuator 40. Essentially, flexible membrane 31 minimizes the energy being transferred from the actuator 40 to the side wall 14, which remains substantially stationary. Consequently, the annular displacement node 22 will remain substantially aligned with the annular pressure node 25 so as to maintain the mode-matching condition of the pump 10. Thus, the axial displacement oscillations of the driven end wall 12 continue to efficiently generate oscillations of the pressure within the cavity 11 from the central pressure anti-node 23 to the peripheral pressure anti-node 24 at the side wall 14 as shown in FIG. 1C.

Figure 6A:
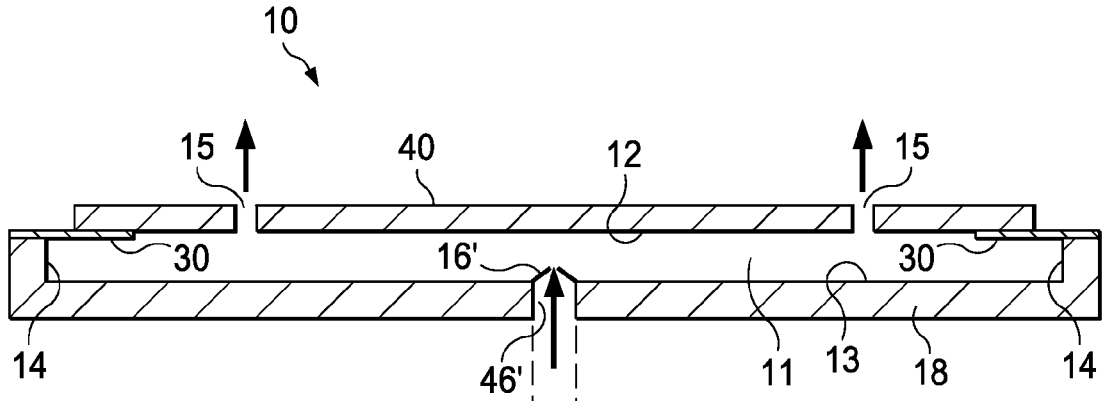
FIG. 6A shows a schematic cross-section view of the pump of FIG. 3
Figure 6B:
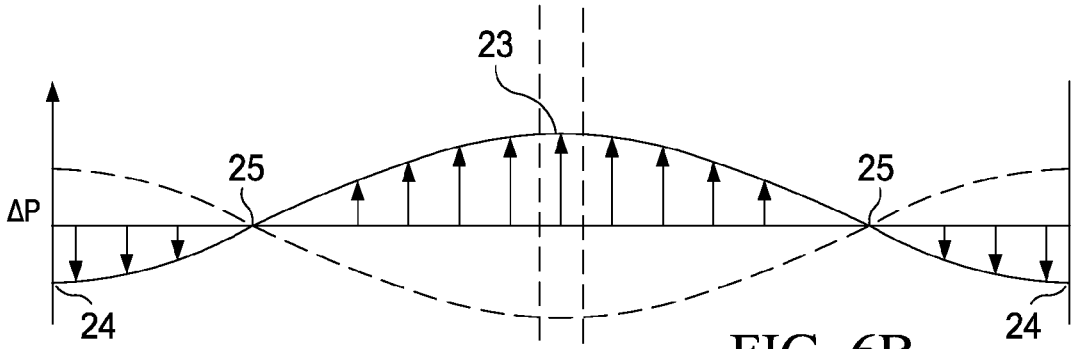
FIG. 6B shows a graph of pressure oscillations of fluid within the pump as shown in FIG. 1C.

FIG. 6A shows a schematic cross-section view of the pump of FIG. 3 and FIG. 6B a graph of the pressure oscillations of fluid within the pump as shown in FIG. 1C. The valve 46' (as well as the valve 46) allows fluid to flow in only one direction as described above. The valve 46' may be a check valve or any other valve that allows fluid to flow in only one direction. Some valve types may regulate fluid flow by switching between an open and closed position. For such valves to operate at the high frequencies generated by the actuator 40, the valves 46 and 46' must have an extremely fast response time such that they are able to open and close on a timescale significantly shorter than the timescale of the pressure variation. One embodiment of the valves 46 and 46' achieve this by employing an extremely light flap valve which has low inertia and consequently is able to move rapidly in response to changes in relative pressure across the valve structure.

Referring to FIGS. 7A-D such a flap valve, valve 110 is shown according to an illustrative embodiment. The valve 110 comprises a substantially cylindrical wall 112 that is ring-shaped and closed at one end by a retention plate 114 and at the other end by a sealing plate 116. The inside surface of the wall 112, the retention plate 114, and the sealing plate 116 form a cavity 115 within the valve 110. The valve 110 further comprises a substantially circular flap 117 disposed between the retention plate 114 and the sealing plate 116, but adjacent the sealing plate 116. The flap 117 may be disposed adjacent the retention plate 114 in an alternative embodiment as will be described in more detail below, and in this sense the flap 117 is considered to be "biased" against either one of the sealing plate 116 or the retention plate 114. The peripheral portion of the flap 117 is sandwiched between the sealing plate 116 and the ring-shaped wall 112 so that the motion of the flap 117 is restrained in the plane substantially perpendicular the surface of the flap 117. The motion of the flap 117 in such plane may also be restrained by the peripheral portion of the flap 117 being attached directly to either the sealing plate 116 or the wall 112, or by the flap 117 being a close fit within the ring-shaped wall 112, in an alternative embodiments. The remainder of the flap 117 is sufficiently flexible and movable in a direction substantially perpendicular the surface of the flap 117, so that a force applied to either surface of the flap 117 will motivate the flap 117 between the sealing plate 116 and the retention plate 114.

The retention plate 114 and the sealing plate 116 both have holes 118 and 120, respectively, which extend through each plate. The flap 117 also has holes 122 that are generally aligned with the holes 118 of the retention plate 114 to provide a passage through which fluid may flow as indicated by the dashed arrows 124 in FIGS. 6C and 8A. The holes 122 in the flap 117 may also be partially aligned, i.e., having only a partial overlap, with the holes 118 in the retention plate 114. Although the holes 118, 120, 122 are shown to be of substantially uniform size and shape, they may be of different diameters or even different shapes without limiting the scope of the invention. In one embodiment of the invention, the holes 118 and 120 form an alternating pattern across the surface of the plates as shown by the solid and dashed circles, respectively, in FIG. 7D. In other embodiments, the holes 118, 120, 122 may be arranged in different patterns without effecting the operation of the valve 110 with respect to the functioning of the individual pairings of holes 118, 120, 122 as illustrated by individual sets of the dashed arrows 124. The pattern of holes 118, 120, 122 may be designed to increase or decrease the number of holes to control the total flow of fluid through the valve 110 as required. For example, the number of holes 118, 120, 122 may be increased to reduce the flow resistance of the valve 110 to increase the total flow rate of the valve 110.

Figure 6C:
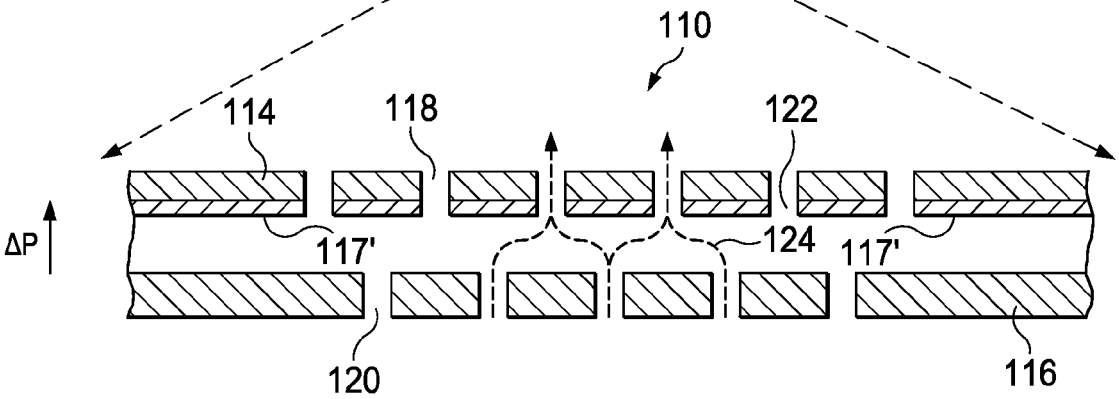
FIG. 6C shows a schematic cross-sectional view of an illustrative embodiment of a valve utilized in the pump of FIG. 3.
Figure 7A:
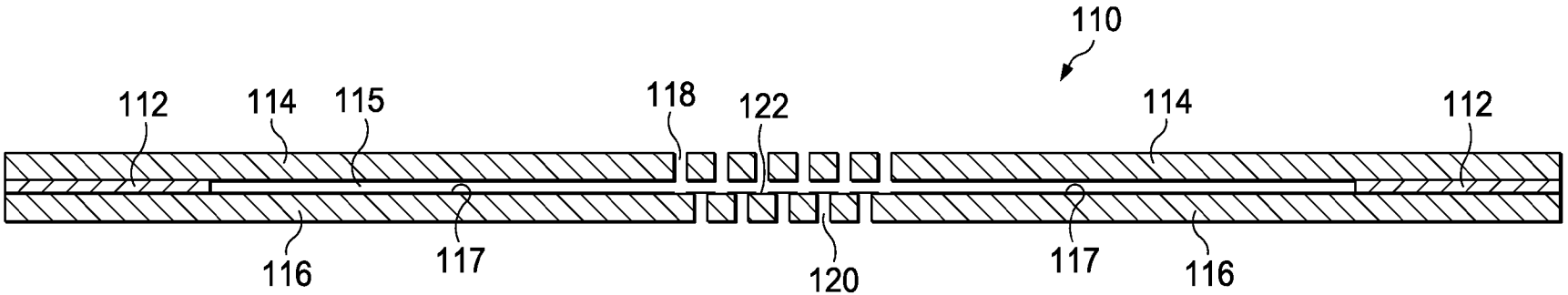
FIG. 7A shows a schematic cross-section view of an illustrative embodiment of a valve in a closed position.
Figure 7B:
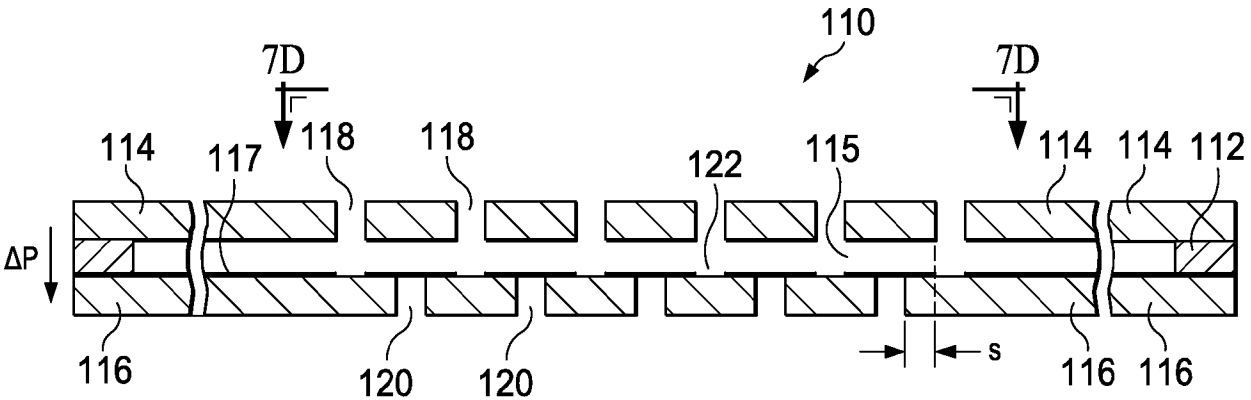
FIG. 7B shows an exploded, sectional view of the valve of FIG. 7A taken along line 7B-7B in FIG. 7D.
Figure 7C:
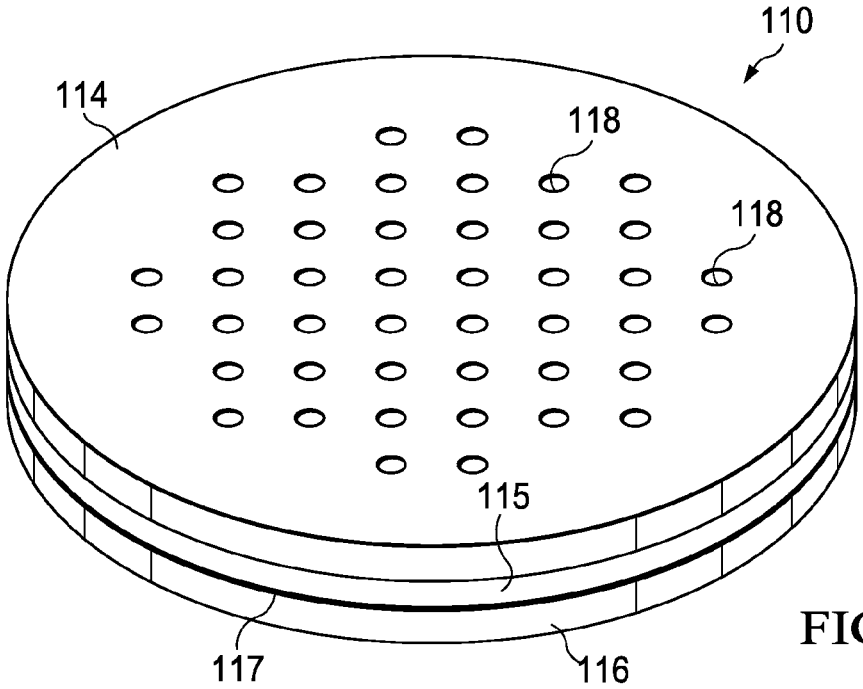
FIG. 7C shows a schematic perspective view of the valve of FIG. 7B.
Figure 8A:
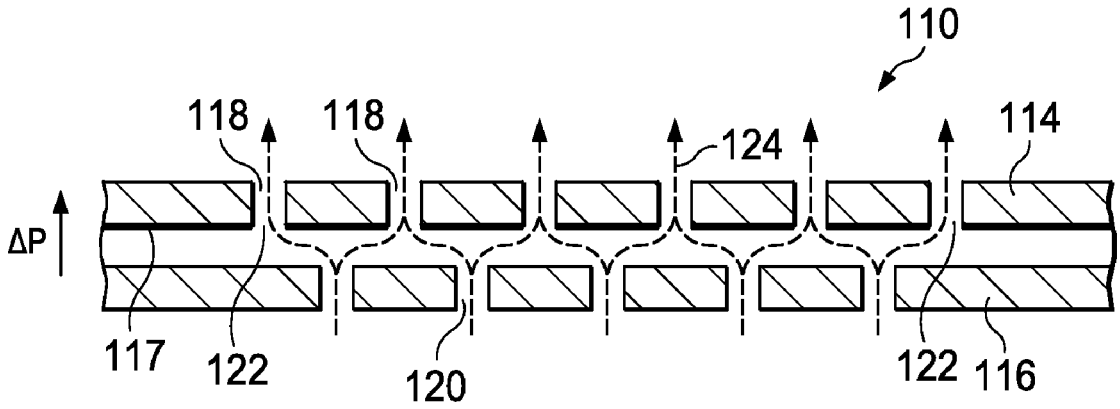
FIG. 8A shows a schematic cross-section view of the valve in FIG. 7B in an open position when fluid flows through the valve.
Figure 8B:
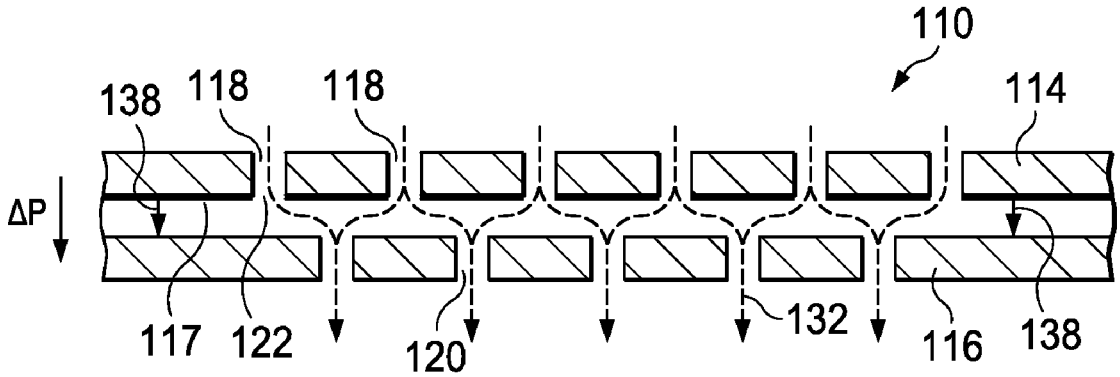
FIG. 8B shows a schematic cross-section view of the valve in FIG. 7B in transition between the open and closed positions.

When no force is applied to either surface of the flap 117 to overcome the bias of the flap 117, the valve 110 is in a "normally closed" position because the flap 117 is disposed adjacent the sealing plate 116 where the holes 122 of the flap are offset or not aligned with the holes 118 of the sealing plate 116. In this "normally closed" position, the flow of fluid through the sealing plate 116 is substantially blocked or covered by the non-perforated portions of the flap 117 as shown in FIGS. 7A and 7B. When pressure is applied against either side of the flap 117 that overcomes the bias of the flap 117 and motivates the flap 117 away from the sealing plate 116 towards the retention plate 114 as shown in FIGS. 6C and 8A, the valve 110 moves from the normally closed position to an "open" position over a time period, an opening time delay ($T_o$), allowing fluid to flow in the direction indicated by the dashed arrows 124. When the pressure changes direction as shown in FIG. 8B, the flap 117 will be motivated back towards the sealing plate 116 to the normally closed position. When this happens, fluid will flow for a short time period, a closing time delay ($T_c$), in the opposite direction as indicated by the dashed arrows 132 until the flap 117 seals the holes 120 of the sealing plate 116 to substantially block fluid flow through the sealing plate 116 as shown in FIG. 7B. In other embodiments of the invention, the flap 117 may be biased against the retention plate 114 with the holes 118, 122 aligned in a "normally open" position. In this embodiment, applying positive pressure against the flap 117 will be necessary to motivate the flap 117 into a "closed" position. Note that the terms "sealed" and "blocked" as used herein in relation to valve operation are intended to include cases in which substantial (but incomplete) sealing or blockage occurs, such that the flow resistance of the valve is greater in the "closed" position than in the "open" position.

The operation of the valve 110 is a function of the change in direction of the differential pressure ($\Delta P$) of the fluid across the valve 110. In FIG. 7B, the differential pressure has been assigned a negative value (−ΔP) as indicated by the downward pointing arrow. When the differential pressure has a negative value (−ΔP), the fluid pressure at the outside surface of the retention plate 114 is greater than the fluid pressure at the outside surface of the sealing plate 116. This negative differential pressure (−ΔP) drives the flap 117 into the fully closed position as described above wherein the flap 117 is pressed against the sealing plate 116 to block the holes 120 in the sealing plate 116, thereby substantially preventing the flow of fluid through the valve 110. When the differential pressure across the valve 110 reverses to become a positive differential pressure (+ΔP) as indicated by the upward pointing arrow in FIG. 8A, the flap 117 is motivated away from the sealing plate 116 and towards the retention plate 114 into the open position. When the differential pressure has a positive value (+ΔP), the fluid pressure at the outside surface of the sealing plate 116 is greater than the fluid pressure at the outside surface of the retention plate 114. In the open position, the movement of the flap 117 unblocks the holes 120 of the sealing plate 116 so that fluid is able to flow through them and the aligned holes 122 and 118 of the flap 117 and the retention plate 114, respectively, as indicated by the dashed arrows 124.

When the differential pressure across the valve 110 changes back to a negative differential pressure (−ΔP) as indicated by the downward pointing arrow in FIG. 8B, fluid begins flowing in the opposite direction through the valve 110 as indicated by the dashed arrows 132, which forces the flap 117 back toward the closed position shown in FIG. 7B. In FIG. 8B, the fluid pressure between the flap 117 and the sealing plate 116 is lower than the fluid pressure between the flap 117 and the retention plate 114. Thus, the flap 117 experiences a net force, represented by arrows 138, which accelerates the flap 117 toward the sealing plate 116 to close the valve 110. In this manner, the changing differential pressure cycles the valve 110 between closed and open positions based on the direction (i.e., positive or negative) of the differential pressure across the valve 110. It should be understood that the flap 117 could be biased against the retention plate 114 in an open position when no differential pressure is applied across the valve 110, i.e., the valve 110 would then be in a "normally open" position.

Referring again to FIG. 6A, the valve 110 is disposed within the primary aperture 46' of the pump 10 so that fluid is drawn into the cavity 11 through the primary aperture 46' and expelled from the cavity 11 through the secondary apertures 15 as indicated by the solid arrows, thereby providing a source of reduced pressure at the primary aperture 46' of the pump 10. The fluid flow through the primary aperture 46' as indicated by the solid arrow pointing upwards corresponds to the fluid flow through the holes 118, 120 of the valve 110 as indicated by the dashed arrows 124 that also point upwards. As indicated above, the operation of the valve 110 is a function of the change in direction of the differential pressure (ΔP) of the fluid across the entire surface of the retention plate 114 of the valve 110 for this embodiment of a negative pressure pump. The differential pressure (ΔP) is assumed to be substantially uniform across the entire surface of the retention plate 114 because the diameter of the retention plate 114 is small relative to the wavelength of the pressure oscillations in the cavity 115 and furthermore because the valve 110 is located in the primary aperture 46' near the centre of the cavity 115 where the amplitude of the central pressure anti-node 71 is relatively constant. When the differential pressure across the valve 110 reverses to become a positive differential pressure (+ΔP) as shown in FIGS. 6C and 8A, the biased flap 117 is motivated away from the sealing plate 116 against the retention plate 114 into the open position. In this position, the movement of the flap 117 unblocks the holes 120 of the sealing plate 116 so that fluid is permitted to flow through them and the aligned holes 118 of the retention plate 114 and the holes 122 of the flap 117 as indicated by the dashed arrows 124. When the differential pressure changes back to the negative differential pressure (−ΔP), fluid begins to flow in the opposite direction through the valve 110 (see FIG. 8B), which forces the flap 117 back toward the closed position (see FIG. 7B). Thus, as the pressure oscillations in the cavity 11 cycle the valve 110 between the normally closed and open positions, the pump 160 provides a reduced pressure every half cycle when the valve 110 is in the open position.

The differential pressure (ΔP) is assumed to be substantially uniform across the entire surface of the retention plate 114 because it corresponds to the central pressure anti-node 71 as described above, it therefore being a good approximation that there is no spatial variation in the pressure across the valve 110. While in practice the time-dependence of the pressure across the valve may be approximately sinusoidal, in the analysis that follows it shall be assumed that the differential pressure (ΔP) between the positive differential pressure (+ΔP) and negative differential pressure (−ΔP) values can be represented by a square wave over the positive pressure time period ($t_{P+}$) and the negative pressure time period ($t_{P-}$) of the square wave, respectively, as shown in FIG. 9A. As differential pressure (ΔP) cycles the valve 110 between the normally closed and open positions, the pump 10 provides a reduced pressure every half cycle when the valve 110 is in the open position subject to the opening time delay ($T_o$) and the closing time delay ($T_c$) as also described above and as shown in FIG. 9B. When the differential pressure across the valve 110 is initially negative with the valve 110 closed (see FIG. 7A) and reverses to become a positive differential pressure (+ΔP), the biased flap 117 is motivated away from the sealing plate 116 towards the retention plate 114 into the open position (see FIG. 7B) after the opening time delay ($T_o$). In this position, the movement of the flap 117 unblocks the holes 120 of the sealing plate 116 so that fluid is permitted to flow through them and the aligned holes 118 of the retention plate 114 and the holes 122 of the flap 117 as indicated by the dashed arrows 124, thereby providing a source of reduced pressure outside the primary aperture 46' of the pump 10 over an open time period ($t_o$). When the differential pressure across the valve 110 changes back to the negative differential pressure (−ΔP), fluid begins to flow in the opposite direction through the valve 110 (see FIG. 7C) which forces the flap 117 back toward the closed position after the closing time delay ($T_c$). The valve 10 remains closed for the remainder of the half cycle or the closed time period ($t_c$).

The retention plate 114 and the sealing plate 116 should be strong enough to withstand the fluid pressure oscillations to which they are subjected without significant mechanical deformation. The retention plate 114 and the sealing plate 116 may be formed from any suitable rigid material such as glass, silicon, ceramic, or metal. The holes 118, 120 in the retention plate 114 and the sealing plate 116 may be formed by any suitable process including chemical etching, laser machining, mechanical drilling, powder blasting, and stamping. In one embodiment, the retention plate 114 and the sealing plate 116 are formed from sheet steel between 100 and 200 microns thick, and the holes 118, 120 therein are formed by chemical etching. The flap 117 may be formed from any lightweight material, such as a metal or polymer film. In one embodiment, when fluid pressure oscillations of 20 kHz or greater are present on either the retention plate side 134 or the sealing plate side 136 of the valve, the flap 117 may be formed from a thin polymer sheet between 1 micron and 20 microns in thickness. For example, the flap 117 may be formed from polyethylene terephthalate (PET) or a liquid crystal polymer film approximately 3 microns in thickness.

In order to obtain an order of magnitude estimate for the maximum mass per unit area of the flap 117 according to one embodiment of the invention, it is again assumed that the pressure oscillation across the valve 110 is a square wave as shown in FIG. 9A and that the full pressure differential is dropped across the flap 117. Further assuming that the flap 117 moves as a rigid body, the acceleration of the flap 117 away from the closed position when the differential pressure reverses from the negative to the positive value may be expressed as follows:

$$\ddot{x} = \frac{P}{m} \quad \text{[Equation 2]}$$

where x is the position of the flap 117, $\ddot{x}$ represents the acceleration of the flap 117, P is the amplitude of the oscillating pressure wave, and m is the mass per unit area of the flap 117. Integrating this expression to find the distance, d, traveled by the flap 117 in a time t, yields the following:

$$d = \frac{P}{2m}t^2 \quad \text{[Equation 3]}$$

This expression may be used to estimate the opening time delay ($T_o$) and the closing time delay ($T_c$), in each case from the point of pressure reversal.

In one embodiment of the invention, the flap 117 should travel the distance between the retention plate 114 and the sealing plate 116, the valve gap ($v_{gap}$) being the perpendicular distance between the two plates, within a time period less than about one quarter (25%) of the time period of the differential pressure oscillation driving the motion of the flap 117, i.e., the time period of the approximating square wave ($t_{pres}$). Based on this approximation and the equations above, the mass per unit area of the flap 117 (*m*) is subject to the following inequality:

$$m < \frac{P}{2d_{gap}}\frac{t_{pres}^2}{16}, \quad \text{[Equation 4]}$$

or alternatively $$m < \frac{P}{2d_{gap}}\frac{1}{16f^2}$$

where $d_{gap}$ is the flap gap, i.e., the valve gap ($v_{gap}$) minus the thickness of the flap 117, and f is the frequency of the applied differential pressure oscillation (as illustrated in FIG. 10). In one embodiment, P may be 15 kPa, f may be 20 kHz, and $d_{gap}$ may be 25 microns, indicating that the mass per unit area of the flap 117 (*m*) should be less than about 60 grams per square meter. Converting from mass per unit area of the flap 117 (*m*), the thickness of the flap 117 is subject to the following inequality:

$$\delta_{flap} < \frac{P}{2d_{gap}}\frac{1}{16f^2}\frac{1}{\rho_{flap}} \quad \text{[Equation 5]}$$

where $\rho_{flap}$ is the density of the flap 117 material. Applying a typical material density for a polymer (e.g., approximately 1400 kg/m$^3$), the thickness of the flap 117 according to this embodiment is less than about 45 microns for the operation of a valve 110 under the above conditions. Because the square wave shown in FIG. 9A in general over-estimates the approximately sinusoidal oscillating pressure waveform across the valve 110, and further because only a proportion of the pressure difference applied across the valve 110 will act as an accelerating pressure difference on the flap 117, the initial acceleration of the flap 117 will be lower than estimated above and the opening time delay ($T_o$) will in practice be higher. Therefore, the limit on flap thickness derived above is very much an upper limit, and in practice, to compensate for the decreased acceleration of the flap 17, the thickness of the flap 17 may be reduced to satisfy the inequality of Equation 5. The flap 117 is thinner so that it accelerates more quickly to ensure that the opening time delay ($T_o$) is less than about one quarter (25%) of the time period of the differential pressure oscillation ($t_{pres}$).

Minimizing the pressure drop incurred as air flows through the valve 110 is important to maximizing valve performance as it affects both the maximum flow rate and the stall pressure that are achievable. Reducing the size of the valve gap ($v_{gap}$) between the plates or the diameter of the holes 118, 120 in the plates both increase the flow resistance and increase the pressure drop through the valve 110. According to another embodiment of the invention, the following analysis employing steady-state flow equations to approximate flow resistance through the valve 110 may be used to improve the operation of the valve 110. The pressure drop for flow through a hole 118 or 120 in either plate can be estimated using the Hagan-Pouisille equation:

$$\Delta p_{hole} = \frac{128\mu q t_{plate}}{\pi d_{hole}^3} \quad \text{[Equation 6]}$$

where μ is the fluid dynamic viscosity, q is the flow rate through the hole, $t_{plate}$ is the plate thickness, and $d_{hole}$ is the hole diameter.

Figure 7D:
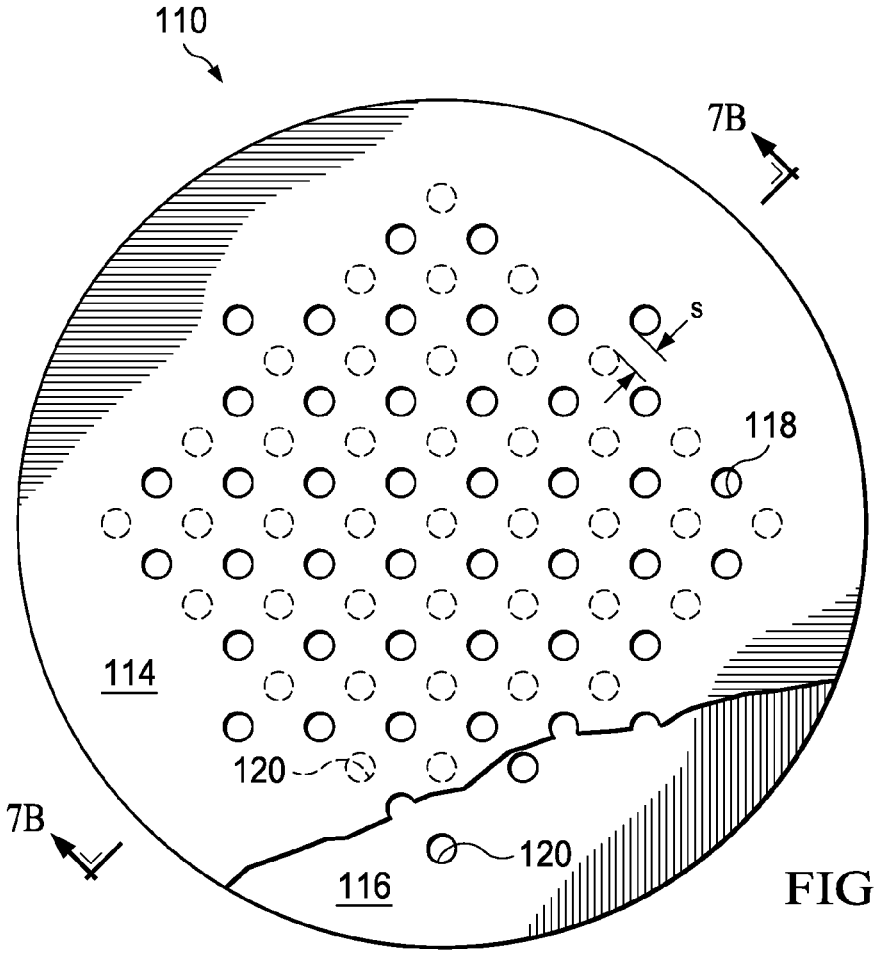
FIG. 7D shows a schematic top view of the valve of FIG. 7B.

When the valve 110 is in the open position as shown in FIG. 7B, the flow of fluid through the gap between the flap 117 and the sealing plate 116 (the same value as the flap gap $d_{gap}$) will propagate generally radially through the gap to a first approximation after exiting the hole 120 in the sealing plate 116 before contracting radially into the hole 118 in the retention plate 114. If the pattern of the holes 118, 120 in both plates is a square array with a sealing length, s, between the holes 118 of the retention plate 114 and the holes 120 of the sealing plate 116 as shown in FIGS. 7B and 7D, the pressure drop through the cavity 115 of the valve 110 may be approximated by the following equation:

$$\Delta p_{gap} = \frac{6\mu q}{\pi d_{gap}^3}\ln\left(2\left(\frac{s}{d_{hole}}+1\right)^2\right) \quad \text{[Equation 7]}$$

Thus, the total pressure drop (approximately $\Delta p_{gap}$+ 2*$\Delta p_{hole}$) can be very sensitive to changes in the diameter of the holes 118, 120 and the flap gap $d_{gap}$ between the flap 117 and the sealing plate 116. It should be noted that a smaller flap gap $d_{gap}$, which can be desirable in order to minimize the opening time delay ($T_o$) and the closing time delay ($T_c$) of the valve 110, may increase the pressure drop significantly. According to the equation above, reducing the flap gap $d_{gap}$ from 25 microns to 20 microns doubles the pressure loss. In many practical embodiments of the valve, it is this trade-off between response time and pressure drop that determines the optimal flap gap $d_{gap}$ between the flap 117 and the sealing plate 116. In one embodiment, the optimal flap gap $d_{gap}$ falls within an approximate range between about 5 microns and about 150 microns.

In setting the diameter of the holes 120 of the sealing plate 116, consideration should be given both to maintaining the stress experienced by the flap 117 within acceptable limits during operation of the valve 110 (such stresses being reduced by the use of a smaller diameter for the holes 120 of the sealing plate 116) and to ensuring that the pressure drop through the holes 120 does not dominate the total pressure drop through the valve 110. Regarding the latter consideration, a comparison between equations 6 & 7 above for the hole and gap pressure drops yields a minimum diameter for the holes 120 at which the hole pressure drop is about equal to the valve gap pressure drop. This calculation sets a lower limit on the desirable diameter of the holes 120 above which diameter the hole pressure drop quickly becomes negligibly small.

Regarding the former consideration relating to the stress experienced by the flap 117 in operation, FIG. 10 illustrates a portion of the valve 10 of FIG. 7B in the normally closed position. In this position, the flap 117 is subjected to stress as the flap 117 seals and blocks the hole 120 in the sealing plate 116 causing the flap 117 to deform in the shape of a dimple extending into the opening of the holes 120 as illustrated. The level of stress on the flap 117 in this configuration increases with the diameter of the holes 120 in the sealing plate 116 for a given flap 117 thickness. The flap 117 material will tend to fracture more easily if the diameter of the holes 120 is too large, thus leading to failure of the valve 110. In order to reduce the likelihood that the flap 117 material fractures, the hole 120 diameter may be reduced to limit the stress experienced by the flap 117 in operation to a level which is below the fatigue stress of the flap 117 material.

The maximum stress experienced by the flap 117 material in operation may be estimated using the following two equations:

$$\frac{\Delta p_{max} r_{hole}^4}{Et^4} = K_1 \frac{y}{t} + K_2 \left(\frac{y}{t}\right)^3 \quad \text{[Equation 8]}$$

$$\frac{\sigma_{max} r_{hole}^2}{Et^2} = K_3 \frac{y}{t} + K_4 \left(\frac{y}{t}\right)^2 \quad \text{[Equation 9]}$$

where $r_{hole}$ is the radius of the hole 120 of the sealing plate 116, t is the flap 117 thickness, y is the flap 117 deflection at the centre of the hole 120, $\Delta p_{max}$ is the maximum pressure difference experienced by the flap 117 when sealed, E is the Young's Modulus of the flap 117 material, and $K_1$ to $K_4$ are constants dependant on the details of the boundary conditions and the Poisson ratio of the flap 117. For a given flap 117 material and geometry of the holes 120, equation 8 can be solved for the deformation, y, and the result then used in equation 9 to calculate stress. For values of y<<t, the cubic and squared y/t terms in equations 8 and 9 respectively become small and these equations simplify to match small plate deflection theory. Simplifying these equations results in the maximum stress being proportional to the radius of the holes 120 squared and inversely proportional to the flap 117 thickness squared. For values of y>>t or for flaps that have no flexural stiffness, the cubic and squared y/t terms in the two equations become more significant so that the maximum stress becomes proportional to the hole 120 radius to the power ⅔ and inversely proportional to the flap 117 thickness to the power ⅔.

In one embodiment of the invention, the flap 117 is formed from a thin polymer sheet, such as Mylar having a Poisson ratio of 0.38, and is clamped to the sealing plate 116 at the edge of the holes 120. The constants $K_1$ to $K_4$ can be estimated as 6.23, 3.04, 4.68 and 1.73, respectively. Using these values in Equations 8 and 9 and assuming that the thickness of the flap 117 is about 3 microns with a Young's Modulus of 4.3 GPa under 500 mbar pressure difference, the deflection (y) of the flap 117 will be approximately 1 μm for a hole radius of 0.06 mm, about 4 μm for a hole radius of 0.1 mm, and about 8 μm for a hole radius of 0.15 mm. The maximum stresses under these conditions will be 16, 34 and 43 MPa, respectively. Considering the high number of stress cycles applied to the flap 117 during the operation of the valve 110, the maximum stress per cycle tolerated by the flap 117 should be significantly lower than the yield stress of the flap 117 material in order to reduce the possibility that the flap 117 suffers a fatigue fracture, especially at the dimple portion of the flap 117 extending into the holes 120. Based on fatigue data compiled for a high number of cycles, it has been determined that the actual yield stress of the flap 117 material should be at least about four times greater than the stress applied to the flap 117 material (e.g., 16, 34 and 43 MPa as calculated above). Thus, the flap 117 material should have a yield stress as high as 150 MPa to minimize the likelihood of such fractures for a maximum hole diameter in this case of approximately 200 microns.

Reducing the diameter of the holes 120 beyond this point may be desirable as it further reduces flap 117 stress and has no significant effect on valve flow resistance until the diameter of the holes 120 approach the same size as the flap gap $d_{gap}$. Further, reduction in the diameter of the holes 120 permits the inclusions of an increased number of holes 120 per unit area of the valve 10 surface for a given sealing length (s). However, the size of the diameter of the holes 120 may be limited, at least in part, by the manner in which the plates of the valve 110 were fabricated. For example, chemical etching limits the diameter of the holes 120 to be greater than approximately the thickness of the plates in order to achieve repeatable and controllable etching results. In one embodiment, the holes 120 in the sealing plate 116 being between about 20 microns and about 500 microns in diameter. In another embodiment, the retention plate 114 and the sealing plate 116 are formed from sheet steel about 100 microns thick, and the holes 118, 120 are about 150 microns in diameter. In this embodiment the valve flap 117 is formed from polyethylene terephthalate (PET) and is about 3 microns thick. The valve gap ($v_{gap}$) between the sealing plate 116 and the retention plate 114 is around 25 microns.

Figure 11A:
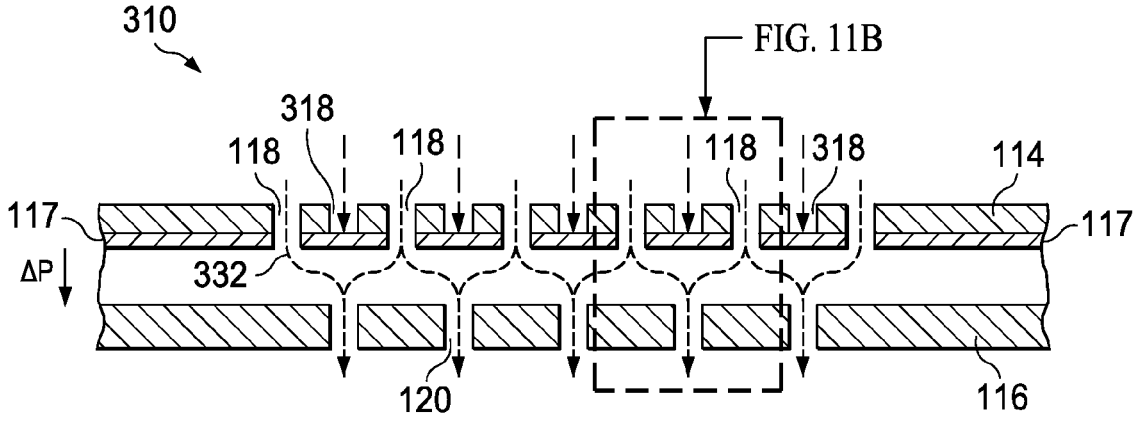
FIG. 11A shows a schematic cross-section view of a modified version of the valve of FIG. 7B having release apertures.
Figure 11B:
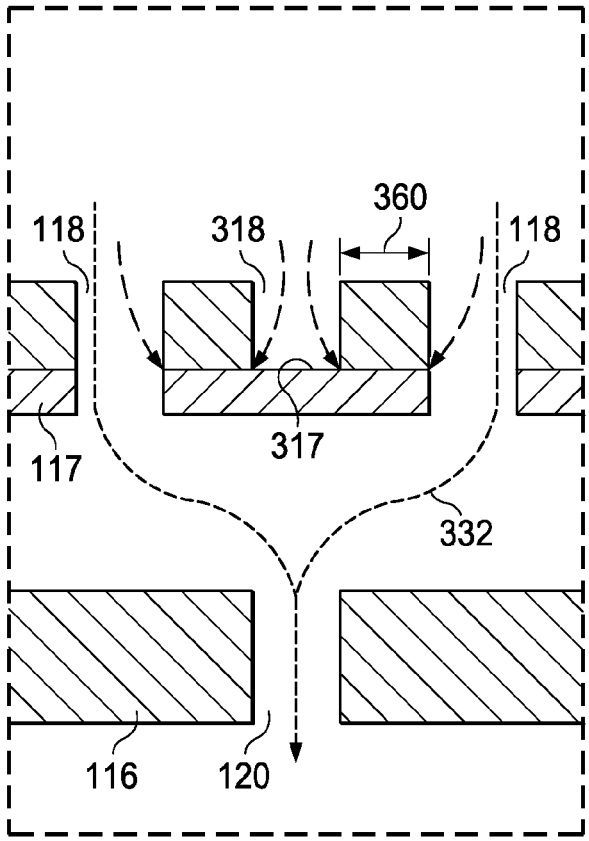
FIG. 11B shows a schematic cross-section view of a portion of the valve in FIG. 11A.

FIGS. 11A and 11B illustrate yet another embodiment of the valve 110, valve 310, comprising release holes 318 extending through the retention plate 114 between the holes 118 in the retention plate 114. The release holes 322 facilitate acceleration of the flap 117 away from the retention plate 114 when the differential pressure across the valve 310 changes direction, thereby further reducing the response time of the valve 310, i.e., reducing the closing time delay ($T_c$). As the differential pressure changes sign and reverse flow begins (as illustrated by dashed arrows 332), the fluid pressure between the flap 117 and the sealing plate 112 decreases and so the flap 117 moves away from the retention plate 114 towards the sealing plate 116. The release holes 318 expose the outside surface 317 of the flap 117 in contact with the retention plate 114 to the pressure differential acting to close the valve 310. Also, the release holes 318 reduce the distance 360 that fluid must penetrate between the retention plate 114 and the flap 117 in order to release the flap 117 from the retention plate 114 as illustrated in FIG. 11B. The release holes 318 may have a different diameter than the other holes 118, 120 in the valve plates. In FIGS. 11A and 11B, the retention plate 114 acts to limit the motion of the flap 117 and to support the flap 117 in the open position while having a reduced surface contact area with the surface 317 of the flap 117.

Figure 12A:
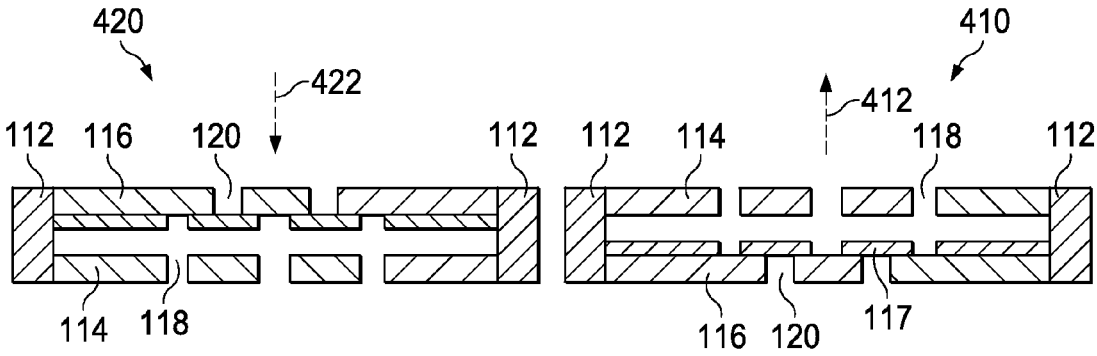
FIG. 12A shows a schematic cross-section view of two valves of FIG. 7B, one of which is reversed to allow fluid flow in the opposite direction from the other according to an illustrative embodiment.
Figure 12B:
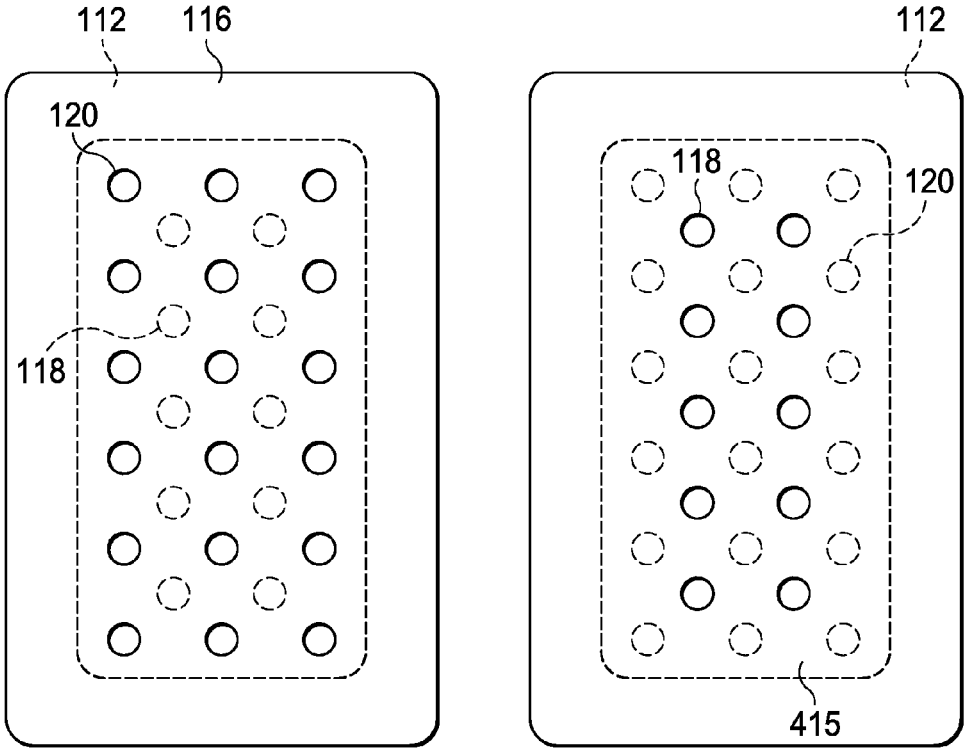
FIG. 12B shows a schematic top view of the valves shown in FIG. 12A.
Figure 12C:
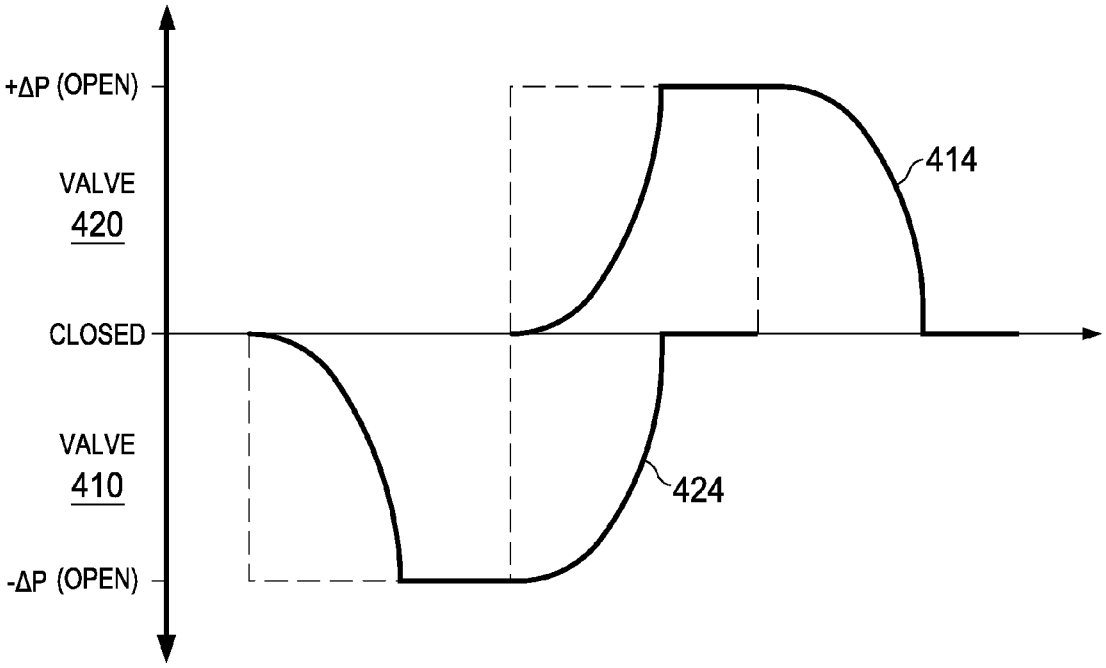
FIG. 12C shows a graph of the operating cycles of the valves of FIG. 12A between an open and closed position.

FIGS. 12A and 12B show two valves 110 as shown in FIG. 7A wherein one valve 410 is oriented in the same position as the valve 110 of FIG. 7A and the other valve 420 is inverted or reversed with the retention plate 114 on the lower side and the sealing plate 116 on the upper side. The valves 410, 420 operate as described above with respect to valve 110 of FIGS. 7A-7C and 8A-8B, but with the air flows in opposite directions as indicated by dashed arrow 412 for the valve 410 and dashed arrow 422 for the valve 420 wherein one valve acts as an inlet valve and the other acts as an outlet valve. FIG. 12C shows a graph of the operating cycle of the valves 410, 420 between an open and closed position that are modulated by the square-wave cycling of the pressure differential (ΔP) as illustrated by the dashed lines (see FIGS. 9A and 9B). The graph shows a half cycle for each of the valves 410, 420 as each one opens from the closed position. When the differential pressure across the valve 410 is initially negative and reverses to become a positive differential pressure (+ΔP), the valve 410 opens as described above and shown by graph 414 with fluid flowing in the direction indicated by the arrow 412. However, when the differential pressure across the valve 420 is initially positive and reverses to become a negative differential pressure (−ΔP), the valve 420 opens as described above and shown by graph 424 with fluid flowing in the opposite direction as indicated by the arrow 422. Consequently, the combination of the valves 410, 420 function as a bi-directional valve permitting fluid flow in both directions in response to the cycling of the differential pressure (ΔP). The valves 410, 420 may be mounted conveniently side by side within the primary aperture 46' of the pump 10 to provide fluid flow in the direction indicated by the solid arrow in the primary aperture 46' as shown in FIG. 6A for one half cycle, and then in the opposite direction (not shown) for the opposite half cycle.

Figure 13:
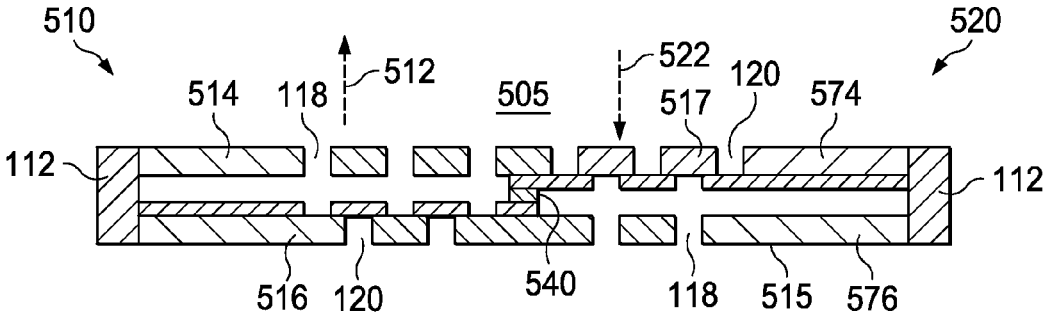
FIG. 13 shows a schematic cross-section view of the a bidirectional valve having two valve portions that allow fluid flow in opposite directions with both valve portions having a normally-closed position according to an illustrative embodiment.
Figure 14:
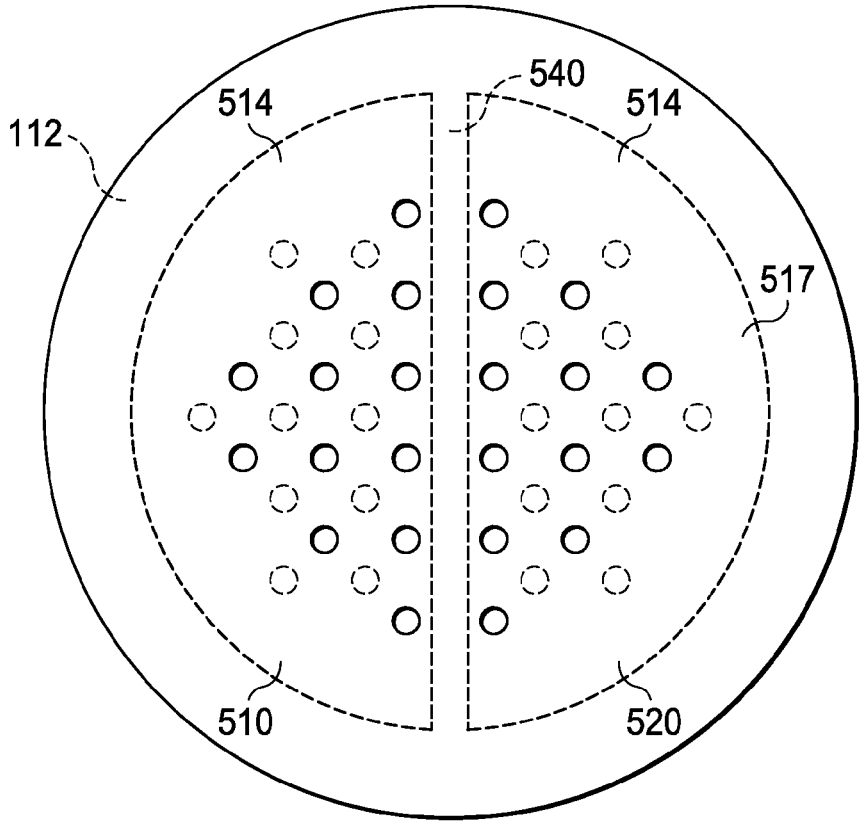
FIG. 14 shows a schematic top view of the bidirectional valves of FIG. 13.

FIGS. 13 and 14 show yet another embodiment of the valves 410, 420 of FIG. 12A in which two valves 510, 520 corresponding to valves 410, 420, respectively, are formed within a single structure 505. Essentially, the two valves 510, 520 share a common wall or dividing barrier 540 which in this case is formed as part of the wall 112, although other constructions may be possible. When the differential pressure across the valve 510 is initially negative and reverses to become a positive differential pressure (+ΔP), the valve 510 opens from its normally closed position with fluid flowing in the direction indicated by the arrow 512. However, when the differential pressure across the valve 520 is initially positive and reverses to become a negative differential pressure (−ΔP), the valve 520 opens from its normally closed position with fluid flowing in the opposite direction as indicated by the arrow 522. Consequently, the combination of the valves 510, 520 function as a bi-directional valve permitting fluid flow in both directions in response to cycling of the differential pressure (ΔP).

Figure 15:
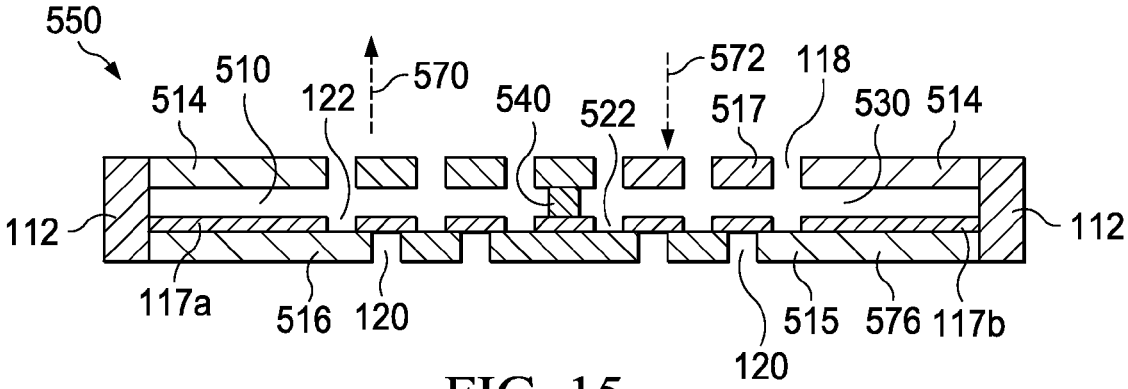
FIG. 15 shows a schematic cross-section view of a bidirectional valve having two valve portions that allow fluid flow in opposite directions with one valve portion having a normally closed position and the other having a normally open position according to an illustrative embodiment.

FIG. 15 shows yet another embodiment of a bi-directional valve 555 having a similar structure as the bi-directional valve 505 of FIG. 14. Bi-directional valve 551 is also formed within a single structure having two valves 510, 530 that share a common wall or dividing barrier 560 which is also formed as part of the wall 112. The valve 510 operates in the same fashion as described above with the flap 117 shown in the normally closed position blocking the holes 20 as also described above. However, the bi-directional valve 550 has a single flap 117 having a first flap portion 117*a* within the valve 510 and a second flap portion 117*b* within the valve 530. The second flap portion 117*b* is biased against the plate 516 and comprises holes 522 that are aligned with the holes 120 of the plate 516 rather than the holes 118 of the plate 514 unlike the valves described above. Essentially, the valve 130 is biased by the flap portion 117*b* in a normally open position as distinguished from the normally closed position of the other valves described above. Thus, the combination of the valves 510, 530 function as a bidirectional valve permitting fluid flow in both directions in response to the cycling of the differential pressure (ΔP) with the two valves opening and closing on alternating cycles.

It should be apparent from the foregoing that an invention having significant advantages has been provided. While the invention is shown in only a few of its forms, it is not just limited but is susceptible to various changes and modifications without departing from the spirit thereof.

We claim:

1. A pump comprising:

a pump body having a substantially cylindrical shaped cavity having a side wall closed by two end surfaces for containing a fluid, the cavity having a height (h) and a radius (r), wherein the ratio of the radius (r) to the height (h) is greater than about 1.2;

an actuator operatively associated with a central portion of one end surface and adapted to cause an oscillatory motion of the end surface with an annular node between the centre of the end surface and the side wall when in use;

an isolator operatively associated with a peripheral portion of the end surface to reduce dampening of the oscillatory motion;

a first valve aperture disposed at any location in the cavity other than at the location of the annular node and extending through the pump body;

a second valve aperture disposed at any location in the pump body other than the location of said first aperture and extending through the pump body; and, a flap valve disposed in at least one of said first valve aperture and second valve aperture to enable the fluid to flow through the cavity when in use, wherein the flap valve comprises:

a first plate having apertures extending generally perpendicular through said first plate;

a second plate having first apertures extending generally perpendicular through said second plate, the first apertures being substantially offset from the apertures of said first plate;

a spacer disposed between said first plate and said second plate to form a cavity therebetween in fluid communication with the apertures of said first plate and the first apertures of said second plate; and, a flap disposed and moveable between said first plate and said second plate, said flap having apertures substantially offset from the apertures of said first plate and substantially aligned with the first apertures of said second plate;

whereby said flap is motivated between said first and second plates in response to a change in direction of the differential pressure of the fluid across said flap valve.

2. The pump of claim 1, wherein said second plate comprises second apertures extending generally perpendicular through said second plate and being spaced between the first apertures of said second plate, whereby the second apertures are offset from the apertures of said flap.

3. The pump of claim 1, wherein said flap is disposed adjacent either one of said first and second plates in a first position when the differential pressure is substantially zero and movable to the other one of said first and second plates in a second position when a differential pressure is applied, whereby said flap is motivated from the first position to the second position in response to a change in direction of the differential pressure of the fluid across said flap valve and back to the first position in response to a reversal in the direction of the differential pressure of the fluid.

4. The pump of claim 1, wherein said flap is disposed adjacent said second plate in a normally open position, whereby the fluid flows through said flap valve when said flap is in the first position and the flow of the fluid is blocked by said flap valve when said flap is in the second position.

5. A pump according to claim 1, wherein said first and second plates are formed from a substantially rigid material selected from the group consisting of metal, plastic, silicon, and glass.

6. A pump according to claim 1, wherein said flap and either one of said first and second plates are separated by a distance between about 5 microns and about 150 microns when said flap is disposed adjacent to the other said plate.

7. A pump according to claim 1, wherein said flap is formed from a light-weight material selected from the group consisting of a polymer and metal.

8. A pump according to claim 1, wherein the apertures in said first plate are less than about 500 microns in diameter.

9. A pump according to claim 1, wherein said flap is formed from a polymer having a thickness of about 3 microns and the apertures in said first plate are less than about 150 microns in diameter.

10. A pump according to claim 1, wherein said first and second plates are formed from steel having a thickness of about 100 microns, and wherein the apertures of said first plate, the first apertures of said second plates, and the apertures of said flap are about 150 microns in diameter, and wherein said flap is formed from a polymer film having a thickness of about 3 microns.

11. A pump according to claim 1, wherein the change in direction of the differential pressure oscillates at a frequency of greater than about 20 kHz.

12. A pump according to claim 1, wherein said first and second plates, said spacer, and said flap comprise a first valve portion, and said flap valve further comprises a second valve portion comprising:

a first plate having apertures extending generally perpendicular through said first plate;

a second plate having first apertures extending generally perpendicular through said second plate, the first apertures being substantially offset from the apertures of said first plate;

a spacer disposed between said first plate and said second plates to form a cavity therebetween in fluid communication with the apertures of said first plate and the first apertures of said second plate; and a flap disposed and moveable between said first plate and said second plate, said flap having apertures substantially offset from the apertures of said first plate and substantially aligned with the first apertures of said second plate;

whereby said flap is motivated between said first and second plates in response to a change in direction of the differential pressure of the fluid across said flap valve; and wherein said first and second valve portions are oriented with respect to the differential pressure to permit fluid to flow through said two portions of said valve in opposite directions in response to cycling of the differential pressure of the fluid across said valve.

13. The pump of claim 1 wherein the oscillatory motion generates radial pressure oscillations of the fluid within the cavity causing fluid flow through said first aperture and second aperture.

14. The pump of claim 1 wherein the height (h) of the cavity and the radius (r) of the cavity are further related by the following equation: $h^2/r>4\times10^{-1}$ meters.

15. The pump of claim 1 wherein said actuator drives the end surface of the cavity associated therewith to cause the oscillatory motion at a frequency (f) wherein the radius (r) is related to the frequency (f) by the following equation:

$$\frac{k_0 c_s}{2\pi f} \le r \le \frac{k_0 c_f}{2\pi f}$$

where $c_s \approx 115$ m/s, $c_r \approx 1970$ m/s, and $k_0 \approx 3.83$.

16. The pump of claim 1 wherein the radius of said actuator is greater than or equal to 0.63(r).

17. The pump of claim 1 wherein said second valve aperture is disposed in one of the end surfaces at a distance of about 0.63(r)±0.2(r) from the centre of the end surface.

18. The pump of claim 1 wherein said valve permits the fluid to flow through the cavity in substantially one direction.

19. The pump of claim 1 wherein the ratio is within the range between about 10 and about 50 when the fluid in use within the cavity is a gas.

20. The pump of claim 1 wherein the ratio of $h^2/r$ is between about $10^{-3}$ meters and about $10^{-6}$ meters when the fluid in use within the cavity is a gas.

21. The pump of claim 1 wherein the volume of the cavity is less than about 10 ml.

22. The pump of claim 1 further comprising:

a second actuator operatively associated with a central portion of the other end surface of the cavity to cause an oscillatory motion of such end surface; and a second isolator operatively associated with a peripheral portion of such end surface to reduce the dampening of the oscillatory motion.

23. The pump of claim 1 wherein said actuator comprises a piezoelectric component for causing the oscillatory motion.

24. The pump of claim 1 wherein said actuator comprises a magnetostrictive component for providing the oscillatory motion.

25. The pump of claim 1 wherein one of the end surfaces of the cavity has a frusto-conical shape wherein the height (h) of the cavity varies from a first height at about the centre of the one end surface to a second height adjacent the side wall smaller than the first height.

26. The pump of claim 1 wherein one of the end surfaces of the cavity has a frusto-conical shape wherein the height (h) of the cavity increases from a first height at about the centre of the one end surface to a second height adjacent the side wall.

27. The pump of claim 1 wherein said flap valve is a bi-directional valve for controlling the flow of fluid in two directions, said bi-directional valve comprising at least two valve portions for controlling the flow of fluid, each of said valve portions comprising:

a first plate having apertures extending generally perpendicular through said first plate;

a second plate having apertures extending generally perpendicular through said second plate, the first apertures being substantially offset from the apertures of said first plates;

a spacer disposed between said first plate and said second plates to form a cavity therebetween in fluid communication with the apertures of said first plate and the apertures of said second plate; and a flap disposed and moveable between said first and second plates, said flap having apertures substantially offset from the apertures of said first plate and substantially aligned with the apertures of said second plate;

whereby said flap is motivated between said first and second plates in response to a change in direction of the differential pressure of the fluid across said valve; and, wherein said first and second valve portions are oriented with respect to the differential pressure to permit fluid to flow through said two portions of said valve in opposite directions in response to cycling of the differential pressure of the fluid across said valve.

28. The pump of claim 3, wherein said flap is disposed adjacent said first plate in a normally closed position, whereby the flow of the fluid is blocked by said flap valve when said flap is in the first position and the fluid flows through said flap valve when said flap is in the second position.

29. The pump of claim 4, wherein said second plate further comprises second apertures extending generally perpendicular through said second plate and spaced between the first apertures of said second plate, whereby the second apertures are offset from the apertures of said flap when in the second position.

30. The pump of claim 28, wherein said second plate further comprises second apertures extending generally perpendicular through said second plate and spaced between the first apertures of said second plate, whereby the second apertures are offset from the apertures of said flap when in the second position.

31. A pump according to claim 5, wherein the metal is steel having a thickness between about 100 and about 200 microns.

32. A pump according to claim 6, wherein said flap is formed from a polymer having a thickness of about 3 microns and the distance between said flap and either one of said first and second plates is between about 15 microns and about 50 microns when said flap is disposed adjacent to the other said plate.

33. A pump according to claim 7, wherein the light-weight material is a polymer having a thickness of less than about 20 microns.

34. A pump according to claim 33, wherein the polymer is polyethylene terephthalate having a thickness of about 3 microns.

35. A pump according to claim 33, wherein the polymer is a liquid crystal film having a thickness of about 3 microns.

36. A pump according to claim 11, wherein said flap has a response time delay less than about twenty-five percent of the time period of the differential pressure oscillations.

37. The pump of claim 12, wherein said flap of each valve portion is disposed adjacent either one of said first and second plates in a first position when the differential pressure is substantially zero and moveable to the other one of said first and second plates in a second position when a differential pressure is applied, whereby each of said flaps is motivated from the first position to the second position in response to a change in direction of the differential pressure of the fluid across said flap valve and back to the first position in response to a reversal in direction of the differential pressure of the fluid.

38. The pump of claim 12, wherein said first and second valve portions are oriented in opposite directions respecting the differential pressure, and said flap of each valve portion is disposed adjacent said second plate in a normally open position, whereby the fluid flows through each of said valve portions when said flaps are in the first position and the flow of the fluid is blocked by said valve portions when said flaps are in the second position.

39. The pump of claim 12, wherein said first and second valve portions are oriented in opposite directions respecting the differential pressure, and said flap of each valve portion is disposed adjacent said first plate in a normally closed position, whereby the flow of the fluid is blocked by said valve portions when said flaps are in the first position and the fluid flows through said valve portions when said flaps are in the second position.

40. The pump of claim 12, wherein said first and second valve portions are oriented in opposite directions respecting the differential pressure, said flap of said first valve portion being disposed adjacent said first plate in a normally closed position whereby the flow of the fluid is blocked by said first valve portion when said flap is in the first position and the fluid flows through said first valve portion when said flap is in the second position, and said flap of said second valve portion being disposed adjacent said second plate in a normally open position whereby the fluid flows through said second valve portion when said flap is in the first position and the flow of the fluid is blocked by said second valve portion when said flap is in the second position.

41. The pump of claim 13 wherein the lowest resonant frequency of the radial pressure oscillations is greater than about 500 Hz.

42. The pump of claim 13 wherein the frequency of the oscillatory motion is about equal to the lowest resonant frequency of the radial pressure oscillations.

43. The pump of claim 13 wherein the frequency of the oscillatory motion is within 20% of the lowest resonant frequency of the radial pressure oscillations.

44. The pump of claim 13 wherein the oscillatory motion is mode-shape matched to the radial pressure oscillations.

45. The pump of claim 16 wherein the radius of said actuator is less than or equal to the radius of the cavity (r).

46. The pump of claim 26 wherein the ratio of the first height to the second height is no less than about 50%.

47. The bi-directional valve of claim 27, wherein said flap of each valve portion is disposed adjacent either one of said first and second plates in a first position when the differential pressure is substantially zero and moveable to the other one of said first and second plates in a second position when a differential pressure is applied, whereby each of said flaps are motivated from the first position to the second position in response to a change in direction of the differential pressure of the fluid across said valve and back to the first position in response to a reversal in the direction of the differential pressure of the fluid.

* * * * *